US009504296B2

(12) United States Patent
Cina et al.

(10) Patent No.: US 9,504,296 B2
(45) Date of Patent: Nov. 29, 2016

(54) MOLD-IN TOUCH FASTENING PRODUCT

(71) Applicant: Velcro BVBA, Deinze (BE)

(72) Inventors: Michael Cina, Toronto (CA); Paul Joseph Voigt, Waterdown (CA); Man Wai Chan, Yuen Long (CN)

(73) Assignee: Velcro BVBA, Deinze (BE)

( * ) Notice: Subject to any disclaimer, the term of this patent is extended or adjusted under 35 U.S.C. 154(b) by 86 days.

(21) Appl. No.: 14/565,764

(22) Filed: Dec. 10, 2014

(65) Prior Publication Data

US 2015/0164186 A1 Jun. 18, 2015

Related U.S. Application Data

(60) Provisional application No. 61/917,475, filed on Dec. 18, 2013.

(51) Int. Cl.
*A44B 18/00* (2006.01)

(52) U.S. Cl.
CPC ..... *A44B 18/0076* (2013.01); *A44B 18/0049* (2013.01); *A44B 18/0061* (2013.01); *Y10T 24/2767* (2015.01)

(58) Field of Classification Search
CPC ..... A44B 18/0076; A44B 18/0061; A44B 18/0049; Y10T 24/2767
See application file for complete search history.

(56) References Cited

U.S. PATENT DOCUMENTS 3,408,705 A 11/1968 Kayser et al.
4,842,916 A 6/1989 Ogawa et al.
5,058,245 A 10/1991 Saito
5,061,540 A 10/1991 Cripps et al.
5,067,210 A 11/1991 Keyaki
(Continued)

FOREIGN PATENT DOCUMENTS

EP 657118 B1 6/1995
EP 1452106 B1 12/2011
(Continued)

OTHER PUBLICATIONS

International Search Report and Written Opinion for PCT/IB2012/002941 mailed Jul. 8, 2013.
(Continued)

*Primary Examiner* — Robert J Sandy
*Assistant Examiner* — Louis Mercado
(74) *Attorney, Agent, or Firm* — Fish & Richardson P.C.

(57) ABSTRACT

A male touch fastener strip includes an elongated base having a thickness and defining a longitudinal direction and a lateral direction perpendicular to the longitudinal direction across the base between longitudinal edges of the base, and a field of male fastener elements each having a stem extending from a broad face of the base and a head at an upper end of the stem and overhanging the base for engaging fibers. The fastener element stems and broad face of the base together form a unitary mass of resin. The male touch fastener strip also includes a pair of longitudinal barrier walls rising from the broad face of the base on either side of the field of male fastener elements, and a plurality of lateral barrier walls. Each of the lateral barrier walls extends between facing surfaces of the longitudinal barrier walls to define a longitudinal column of bounded fastening cells that each contain one or more male fastener elements. Each lateral barrier wall defines at least one gap extending therethrough and connecting adjacent fastening cells.

16 Claims, 27 Drawing Sheets

(56) References Cited

U.S. PATENT DOCUMENTS

| | | | | |
|---|---|---|---|---|
| 5,342,569 | A | 8/1994 | Murasaki | |
| 5,500,268 | A | 3/1996 | Billarant | |
| 5,537,720 | A | 7/1996 | Takizawa et al. | |
| 5,606,781 | A | 3/1997 | Provost et al. | |
| 5,657,517 | A | 8/1997 | Akeno et al. | |
| 5,688,576 | A | 11/1997 | Ohno et al. | |
| 5,715,581 | A | 2/1998 | Akeno | |
| 5,725,928 | A | 3/1998 | Kenney et al. | |
| 5,766,723 | A | 6/1998 | Oborny et al. | |
| 6,463,635 | B2 | 10/2002 | Murasaki | |
| 6,656,563 | B1 | 12/2003 | Leach et al. | |
| 6,720,059 | B2 | 4/2004 | Fujisawa et al. | |
| 6,803,010 | B2 | 10/2004 | Leach et al. | |
| 6,896,759 | B2 | 5/2005 | Fujisawa et al. | |
| 7,022,394 | B2 | 4/2006 | Fujisawa et al. | |
| 7,608,070 | B2 | 10/2009 | Chen et al. | |
| 9,034,452 | B2 * | 5/2015 | Cina | B32B 3/30 428/100 |
| 9,138,032 | B1 * | 9/2015 | Cina | A44B 18/0076 |
| 2002/0164449 | A1 | 11/2002 | Fujisawa et al. | |
| 2002/0164451 | A1 | 11/2002 | Fujisawa et al. | |
| 2005/0160534 | A1 | 7/2005 | Akeno et al. | |
| 2007/0098953 | A1 | 5/2007 | Stabelfeldt et al. | |
| 2010/0181695 | A1 | 7/2010 | Murasaki et al. | |
| 2011/0197404 | A1 * | 8/2011 | Terada | A44B 18/0049 24/442 |
| 2013/0149490 | A1 | 6/2013 | Cina et al. | |
| 2014/0130311 | A1 * | 5/2014 | Okuda | A44B 18/0049 24/449 |
| 2015/0335106 | A1 * | 11/2015 | Okuda | A44B 18/0076 24/443 |

FOREIGN PATENT DOCUMENTS

| | | | |
|---|---|---|---|
| GB | 2468869 | A | 9/2010 |
| WO | WO9625064 | A2 | 8/1996 |
| WO | WO0189338 | A2 | 11/2001 |

OTHER PUBLICATIONS

International Search Report and Written Opinion for PCT/EP2014/077568 mailed Feb. 19, 2015.

* cited by examiner

MOLD-IN TOUCH FASTENING PRODUCT

TECHNICAL FIELD

The present invention relates to touch fastening products, and more particularly to touch fastening products configured to be incorporated into molded articles.

BACKGROUND

Traditionally, hook-and-loop fasteners comprise two mating components that releasably engage with one another, thus allowing coupling and decoupling of the two surfaces or objects. The male fastener portion typically includes a substrate having fastener elements, such as hooks, extending from the substrate. Such fastener elements are referred to as "loop-engageable" in that they are configured to releasably engage with fibers of the mating component to form the hook- and loop-fastening.

Among other things, hook-and-loop fasteners are employed to attach upholstery to car seat cushions. Car seat cushions are typically made of a foam material. To attach the upholstery to the foam, one fastener product is incorporated at a surface of the foam car seat and the mating component is incorporated into the upholstery, or is provided by the upholstery itself. The male fastener elements releasably engage with the mating component to couple the upholstery to the foam car seat.

To incorporate a male fastener product into a foam cushion, the fastener product may be positioned within a cushion mold, such that as foam fills the mold to form the cushion, the foam adheres to the fastener product. Flooding of the fastener elements by the foam during forming of the cushion is generally seen as inhibiting the usefulness of the fastener elements, and so several improvements have been made to attempt to avoid such foam intrusion.

Further advances in the design of fastener products are sought, for this and for other applications.

SUMMARY

One aspect of the invention features a male touch fastener strip including an elongated base having a thickness and defining a longitudinal direction and a lateral direction perpendicular to the longitudinal direction across the base between longitudinal edges of the base, and a field of male fastener elements each having a stem extending from a broad face of the base and a head at an upper end of the stem and overhanging the base for engaging fibers. The fastener element stems and broad face of the base together form a unitary mass of resin. A pair of longitudinal barrier walls rises from the broad face of the base on either side of the field of male fastener elements. The male touch fastener strip also includes a plurality of lateral barrier walls. Each of the lateral barrier walls extends between facing surfaces of the longitudinal barrier walls to define a longitudinal column of bounded fastening cells that each contain one or more of the male fastener elements. Each lateral barrier wall defines at least one gap extending therethrough and connecting adjacent fastening cells.

In some examples, each lateral barrier wall defines multiple gaps extending therethrough. In some applications, the longitudinal column of bounded fastening cells includes a series of at least four bounded fastening cells.

In some cases, the gaps defined by the lateral barrier walls extend from the broad face of the base. In some cases, the gaps defined by the lateral barrier walls extend through an upper extent of the lateral barrier walls.

In some implementations, the gaps defined by the lateral barrier walls each define a lateral gap width. The lateral gap width is preferably between about 0.002 and 0.015 inch, more preferably between about 0.004 and 0.012 inch.

In some examples, the gaps defined by the lateral barrier walls each have a width that is constant over different distances from the broad face of the base. In some examples, the gaps defined by the lateral barrier walls each have a width that varies with distance from the broad face of the base. In some cases, the gaps defined by the lateral barrier walls are wider at their distal extent than at a height closer to the broad face of the base.

In some embodiments, the lateral barrier walls each have a height at least as great as that of the male fastener elements. In some embodiments, the lateral barrier walls are spaced apart from one another by between 0.3 and 0.5 inch in the longitudinal direction.

Some examples of the male touch fastener strip feature foam disrupters rising from the broad surface of the base within the fastening cells adjacent the gaps. In some embodiments, the foam disrupters are of a height less than a height of the lateral barrier walls, while in some other cases they extend to the same height as the lateral barrier walls. In some embodiments, the foam disrupters extend, in a side profile, to distal points that define a point radius. In some cases, the point radius is less than 0.0015 inch.

In some implementations, the broad face of the base defines a longitudinal groove connecting and forming a lower extent of the gaps defined by the lateral barrier walls.

In some examples, the longitudinal barrier walls are lengthwise continuous. In some examples, the longitudinal walls each include a longitudinal column of spaced-apart wall segments defining longitudinal gaps therebetween. The longitudinal gaps may have a maximum width along the longitudinal direction of the base. In some cases, the maximum width of the longitudinal gaps is at least about 0.02 inch.

In some embodiments, the male touch fastener strip includes a chain of fastening segments, each segment including respective longitudinal portions of the base, the field of male fastener elements, the longitudinal barrier walls and at least two lateral barrier walls. Each segment is connected to at least one adjacent segment of the chain by a flexible neck of less width than the segment.

Some examples of the male touch fastener strip have a pair of segmented walls rising from the broad face of the base. Each segmented wall of the pair is disposed laterally outboard of a respective nearest one of the longitudinal barrier walls. Each segmented wall includes a series of wall segments defining longitudinal gaps therebetween. In some cases, each segmented wall and its nearest longitudinal barrier wall define therebetween a foam relief space for receiving a foam material, each respective foam relief space having a volume per unit strip length. In some cases, each segmented wall defines a longitudinal flow gap for allowing the foam material to enter the foam relief space, each respective flow gap having an area per unit strip length. In some examples, the ratio of foam relief space volume per unit strip length and flow gap area per unit strip length is between about 0.02 and 0.80 inch. By "volume per unit strip length" we mean the product of the distance between facing surfaces of a respective segmented wall and its nearest barrier wall and the height of the barrier wall. Each segmented wall defines a flow gap for allowing the foam material to enter the foam relief space, each respective flow gap having an area per unit strip length. By "flow gap" we mean the total exposed area of all flow enabled openings through and around a segmented wall.

Another aspect of the invention features a male touch fastener strip including an elongated base having a thickness and defining a longitudinal direction and a lateral direction perpendicular to the longitudinal direction across the base between longitudinal edges of the base, and a field of male fastener elements each having a stem extending from a broad face of the base and a head at an upper end of the stem and overhanging the base for engaging fibers. The fastener element stems and broad face of the base together form a unitary mass of resin. The male touch fastener strip also includes a pair of longitudinal barrier walls rising from the broad face of the base on either side of the field of male fastener elements. The broad face of the base defines a longitudinal groove disposed between the longitudinal barrier walls and between adjacent longitudinal columns of the male fastener elements, the base having a thickness in the groove of less than about 70 percent of a nominal thickness of the base on either side of the groove.

In some examples, the male touch fastener strip includes a plurality of lateral barrier walls, each of the lateral barrier walls extending between facing surfaces of the longitudinal barrier walls to define a longitudinal column of bounded fastening cells that each contain one or more of the male fastener elements. In some cases, each lateral barrier wall defines at least one gap aligned with the groove and connecting adjacent fastening cells.

Yet another aspect of the invention features a male touch fastener strip including an elongated base having a thickness and defining a longitudinal direction and a lateral direction perpendicular to the longitudinal direction across the base between longitudinal edges of the base, and a field of male fastener elements each having a stem extending from a broad face of the base and a head at an upper end of the stem and overhanging the base for engaging fibers. The fastener element stems and broad face of the base together form a unitary mass of resin. A pair of longitudinal barrier walls rises from the broad face of the base on either side of the field of male fastener elements. The male touch fastener strip also includes a pair of segmented lateral barrier walls extending between facing surfaces of the longitudinal barrier walls to separate two adjacent fastening cells that each contain one or more of the male fastener elements. Each segmented lateral barrier wall includes multiple segments separated by gaps. The segments of one of the lateral barrier walls are laterally offset from the segments of the other of the lateral barrier walls, such that the pair of lateral barrier walls together defines effective gaps connecting the adjacent fastening cells.

In some implementations, the effective gaps are narrower than the gaps separating the segments of each lateral barrier wall. In some examples, the segments of each lateral barrier wall are spaced from all segments of the other lateral barrier wall. In some examples, the longitudinal barrier walls and the segments of the lateral barrier walls extend to a similar height from the base. In some cases, the effective gaps between the adjacent segments of the lateral barrier walls have an effective gap width greater than zero and less than about 0.003 inch, more preferably less than about 0.0015 inch.

Many of the features of the examples described herein can help to promote secure attachment of the fastener strip within a foam body, such as a seat cushion. Providing a fastening product with gaps extending through lateral walls separating fastening cells can permit air to flow between the cells during the mold-in process, and can in some cases help to avoid undesirable lifting of the fastening product from the mold surface due to air expansion, and may equalize pressure between cells, helping to avoid 'burping' or rapid release of air from under the fastening product. Such gaps can also increase the flexibility of the fastening product, permitting the fastening product to more readily bend about an axis running along its length, or to otherwise conform to curved mold surfaces without buckling. Additionally, the foam may flow into fastener cells adjacent ends of the product through the gaps, which may further help to anchor the ends of the fastening product in the molded foam article.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
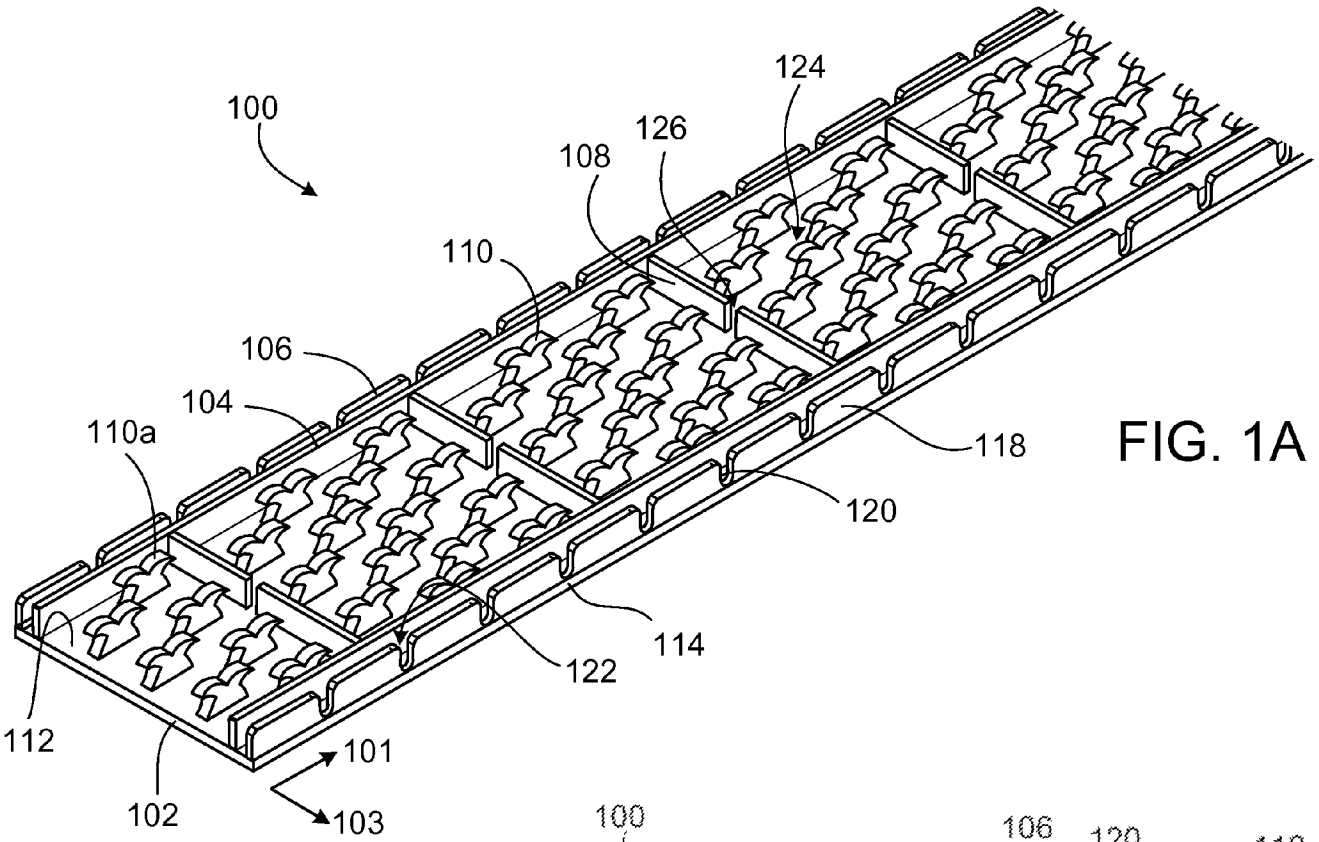
FIGS. 1A-1C are perspective, side, and top views of a first fastening product.
Figure 1B:
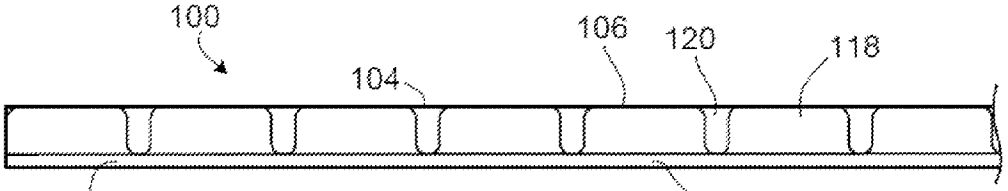
Figure 1C:
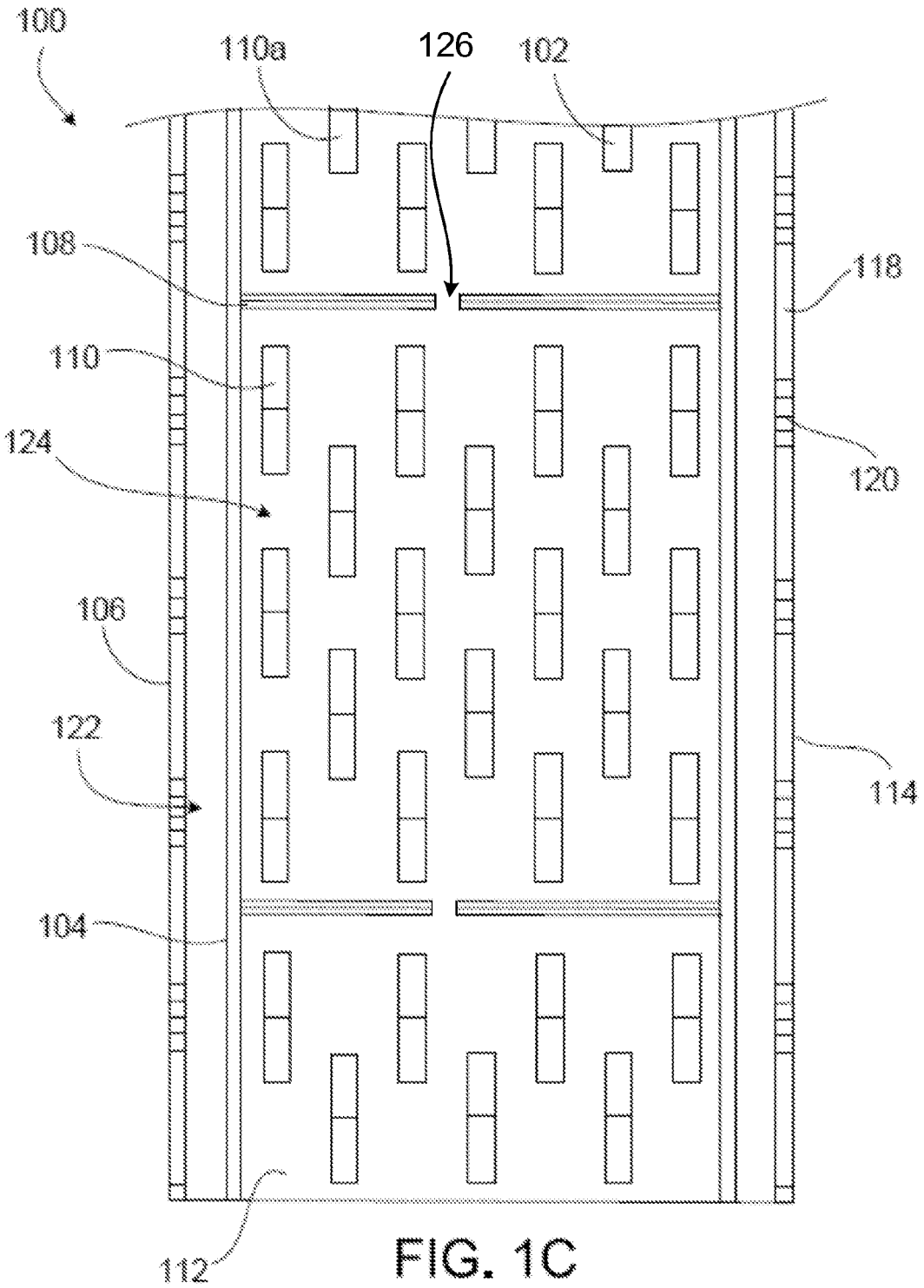

Referring to FIGS. 1A-1C, a fastening product 100 includes a substrate 102, barrier walls 104, segmented walls 106, lateral walls 108, and fastener elements 110. Substrate 102 defines a longitudinal (i.e., lengthwise) direction 101, and a lateral (i.e., widthwise) direction 103 that is perpendicular to the longitudinal direction. The substrate is a flexible, elongated base sheet of molded resin. Lateral walls 108 extend integrally from an upper surface 112 of the substrate 102. Each of the lateral walls 108 extends between facing surfaces of longitudinal barrier walls 104 to define a longitudinal column of bounded fastening cells 124 containing one or more of the fastener elements 110. Each lateral wall 108 defines at least one gap 126 extending therethrough and connecting adjacent fastening cells 124.

In this example, barrier walls 104 are continuous and extend integrally from upper surface 112 of the substrate 102. In some implementations, however, barrier walls 104 are discontinuous and can include a longitudinal column of spaced-apart wall segments defining longitudinal gaps therebetween (as described in detail below). In this example, the fastener product includes a pair of barrier walls spanning the length of the substrate in the longitudinal direction. Each of barrier walls 104 are positioned inboard of a respective longitudinal edge 114 of substrate 102.

When fastening product 100 is held against a flat surface, such as a surface of a mold pedestal (as discussed in detail below), barrier walls 104 contact the mold pedestal surface to inhibit (if not prevent) flowing resin from contacting fastening elements 110. Accordingly, in this example, the height of barrier walls 104 is at least as great as that of fastener elements 110. In some implementations, however, barrier walls 104 can be slightly shorter than fastener elements 110 (e.g., 0.004 inch or less in height). In these implementations, the barrier walls may not contact the mold pedestal surface. In some examples, a gap exists between the barrier walls and the flat surface of the pedestal that is small enough to inhibit or prevent foam intrusion. In some examples, the fastener elements are configured to bend or compress when held by force against the mold pedestal, to bring the barrier walls in contact with the flat surface of the pedestal.

Each of segmented walls 106 are disposed outboard of a respective barrier wall 104 (in lateral direction 103). In this example, segmented walls 106 are positioned along respective longitudinal edges 114 of substrate 102. Other appropriate configurations, however, can also be implemented. For example, segmented walls 106 can be positioned substantially inboard of longitudinal edges 114, leaving hang-over extensions of the substrate outboard of the segmented walls. In this example, segmented walls 106 extend integrally from upper surface 112 and run parallel to barrier walls 104 down the length of substrate 102. As shown, each of segmented walls 106 includes a series of discrete wall segments 118. Wall segments 118 are spaced apart from one another to form longitudinal gaps 120 between adjacent segments. In some examples, the wall segments extend about 0.06 inch in the longitudinal direction of the base. Longitudinal gaps 120 can allow a flowable material (e.g., a liquefied or partially expanded foam) to pass through the segmented wall. In some examples, the longitudinal gaps have a maximum width along the longitudinal direction of the base that is at least about 0.02 inch. In a particular example, the longitudinal gaps have a width of about 0.11 inch.

Each of segmented walls 106 defines a respective flow gap. A flow gap can be described as the total exposed area of all flow enabled openings through and around the segmented wall. In this example, each of wall segments 118 has a height equaling that of barrier walls 104. Accordingly, the accumulation of longitudinal gaps 120 defines the flow gap of each segmented wall 106. In some implementations, however, the wall segments can be shorter than the barrier walls to augment the flow gap (as described in detail below). The dimensions of the flow gaps can be measured in terms of area per unit strip length of substrate 102. The dimensions of the flow gaps define the amount of foam that is allowed to pass through the segmented walls during the molding process of a foam article. In some examples, the flow gaps constitute between 8 percent and 50 percent of the effective area of the segmented walls.

Foam passing through segmented walls 106 enters foam relief spaces 122. The foam relief spaces are delimited by a respective segmented wall and its nearest barrier wall. The dimension of a foam relief space 122 can be measured in terms of its volume per unit strip length of substrate 102. The volume per unit strip length can be defined as a product of the distance between facing surfaces of a respective segmented wall and its nearest barrier wall and the height of the barrier wall.

In some cases, imperfections in a mold pedestal surface (e.g., scratches, dents, or uneven surfaces) can allow foam to flow past the barrier walls 104 and into contact with fastener elements 110. This can be inhibited (if not prevented), however, by permitting foam to enter and set-up in foam relief spaces 122. In some examples, the cured or solidified foam can form an integral seal with the mold tool surface, preventing flow past the barrier walls. Additionally, allowing the foam to set-up around wall segments 118 can increase the bond strength between fastening product 100 and a foam molded article (e.g., a seat cushion). For instance, the solidified foam around wall segments 118 can act as an anchor holding fastening product 100 to the seat cushion. In some examples, the fastener product is configured to achieve an appropriate ratio of foam relief space volume per unit strip length and flow gap area per unit strip length. This ratio will be referred to herein as the "foam relief ratio". In some examples, the flow gaps and foam relief space can be appropriately dimensioned to provide an appropriate foam relief ratio.

Providing a fastener product with an appropriate foam relief ratio allows the foam passing through the flow gaps of segmented walls 106 to expand and set-up around wall segments 118, without exerting excessive force on fastening product 100. For example, when the foam relief ratio is too large, a deficient amount of foam enters the foam relief space. As a result, the solidified foam may not provide a strong anchor to the foam molded article. Conversely, when the foam relief ratio is too small, an excessive amount of foam enters the foam relief space. When the excessive amount of foam expands, a force is exerted on the fastening product (e.g., against substrate 102 and barrier walls 104). In some cases, the force may be sufficient to urge the fastening product away from the mold pedestal surface, allowing foam to pass under the barrier walls. In some examples, an appropriate foam relief ratio is between about 0.02 and 0.80 inch. Foam relief ratios between about 0.20 and 0.50 inch or about 0.30 and 0.45 inch can also be implemented.

Fastener elements 110 are flexible and extend upward from upper surface 112 of substrate 102. The fastener elements are arranged in discrete fields or arrays separated by lateral walls 108. Each of fastener elements 110 has a head spaced above upper surface 112, and each head has two distal tips that extend in opposite directions to form loop overhangs (i.e., palm-tree type fastening elements). Thus, the fastener elements are configured to releasably engage fibers of a mating component (not shown) to form a hook-and-loop fastening. Other appropriate types of fastening elements can also be used. For example, J-hook and/or mushroom-type fastening elements can be implemented.

In this example, lateral walls 108 laterally traverse an inner area between facing surfaces of respective barrier walls 104 to isolate arrays of fastener elements 110. In some implementations, however, the lateral walls extend beyond the barrier walls, traversing the inner area between facing surfaces of the outer segmented walls. Lateral walls 108, in conjunction with barrier walls 104 demarcate individual fastening cells 124. The fastener cells are effectively sealed against ingress of foam, when the fastening product is held against a flat surface of a mold pedestal. Each lateral wall 108 defines one or more gaps extending therethrough and connecting adjacent fastening cells 124. In this example, each lateral wall 108 defines one gap 126. The gaps 126 can extend from upper surface 112 of the substrate 102. The gaps 126 can also extend through an upper extent of the lateral walls 108. Other appropriate gap configurations, however, can also be implemented (as described in detail below).

The gaps 126 each define a lateral width. An appropriate lateral width of the gaps is configured to balance the properties of the fastening product, e.g., air releasing capability, bending flexibility, resistance to foam intrusion, and retention. The air releasing capability and flexibility of the fastening product increase with the presence and number of gaps, and resistance to foam intrusion decreases with the lateral width of the gaps. In some examples, the lateral gap width can be equal to a lateral width of the fastener elements 110. In a particular example, the lateral gap width is between about 0.002 and 0.015 inch or between about 0.004 and 0.012 inch. In some implementations, the lateral width of the gaps is constant over different distances from upper surface 112, such as when the gaps are defined between straight wall surfaces. In some other implementations, the lateral width of the gaps varies with distance from upper surface 112, e.g., the gaps are wider at their distal extent than at a height closer to upper surface 112.

As shown in FIGS. 1A and 1C, the lateral walls 108 are disposed at predetermined intervals down the length of the substrate. In this manner, lateral walls 108 allow fastener product 100 to be manufactured in continuous spools that can be severed to form various lengths of fastening strips. In some examples, the inner surfaces of the lateral walls are spaced apart from one another by between about 0.3 and 0.5 inch. In some examples, a continuous spool of the fastener product can be severed so as to leave a number of fastening elements 110*a* exposed to foam (as shown in FIG. 1A). The exposed fastening elements can act as anchor points to the molded foam article. Further, as with barrier walls 104 and segmented walls 106, lateral walls 108 can extend integrally from upper surface 112. The height of lateral walls 108 can be equal to that of barrier walls 104.

In a particular example, each of barrier walls 104, segmented walls 106, and lateral walls 108 extend from upper surface 112 of substrate 102 to a height of 0.051 inch. Barrier walls 104 and segmented walls 106 are provided having a thickness of 0.012 inch. In a particular example, the distance between facing surfaces of barrier walls 104 is 0.364 inch, and the distance between lateral walls 108 is 0.450 inch. Accordingly, the area of fastening cells 124 is about 0.164 inch. Such fastening cells can, for example, accommodate an array of 18 fastener elements. In a particular example, wall segments 118 have a length of about 0.124 inch and are spaced apart by about 0.029 inch to form longitudinal gaps 120. In a particular example, the width of foam relief spaces 122 (i.e., the distance between facing surfaces of a segmented wall and its nearest barrier wall) is 0.030 inch. Accordingly, the foam relief ratio is about 0.16 inch. In some examples, the combined width of the foam relief spaces can be between about 10 percent and 35 percent of the total width of the substrate.

Figure 1D:
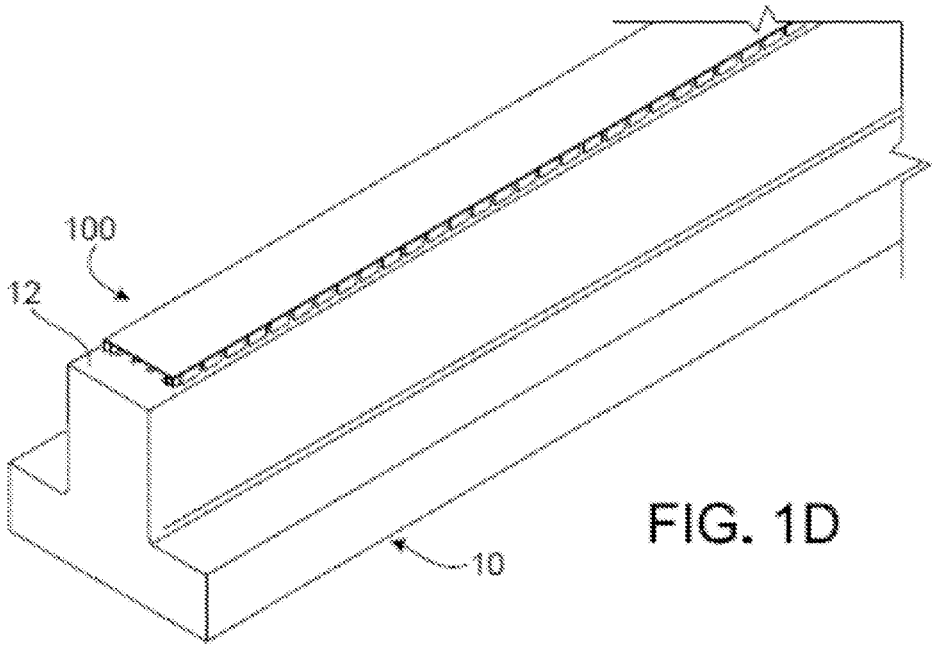
FIGS. 1D and 1E are perspective and side views of the fastening product of FIG. 1, held against the surface of a mold pedestal.
Figure 1E:
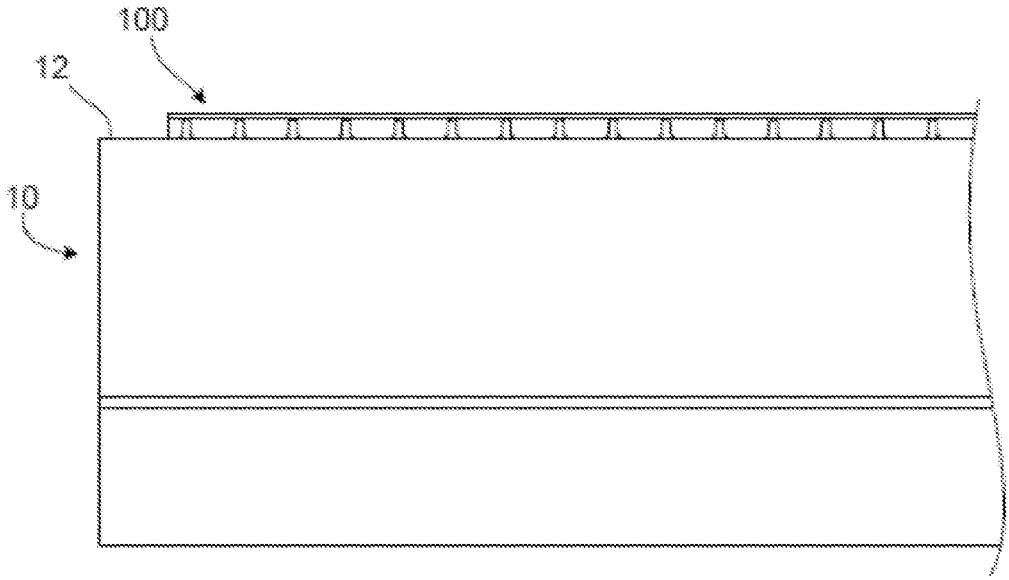

Turning to FIGS. 1D and 1E, fastener product 100 can be held against a mold pedestal 10. For example, one or more elements of fastener product 100 can be formed as a contiguous mass of magnetically attractable resin, such that the fastening product is attracted by a magnet to hold it against a flat mold pedestal surface 12. When fastener product 100 is held against mold pedestal 10, its barrier walls and lateral walls contact mold pedestal surface 12 such that flow of foam passed the barrier walls and into contact with the fastener elements is inhibited (if not prevented). As discussed above, longitudinal gaps between neighboring outer wall segments of the fastener product provide a flow gap allowing foam to enter appropriately dimensioned foam relief spaces.

Figure 1F:
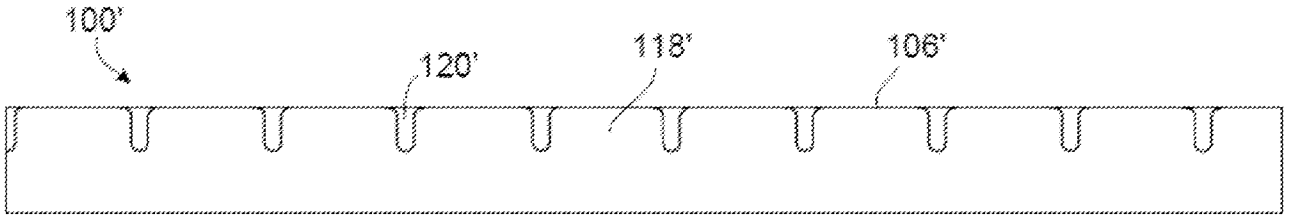
FIG. 1F is a side view of a first fastening product modified for ease of manufacturing.

FIG. 1F shows a modified fastener product 100', where the longitudinal gaps 120' between the wall segments 118' extend partway down the segmented wall 106' (as opposed to entirely down the segmented wall as shown in FIGS. 1A and 1B). This modified fastener product can be easier to manufacture while still providing a sufficient flow gap. In this example, the fastener product was designed such that the flow gaps constitute about 8.4 percent of the effective area of the segmented walls. In addition, the foam relief ratio is about 0.40.

Figure 1G:
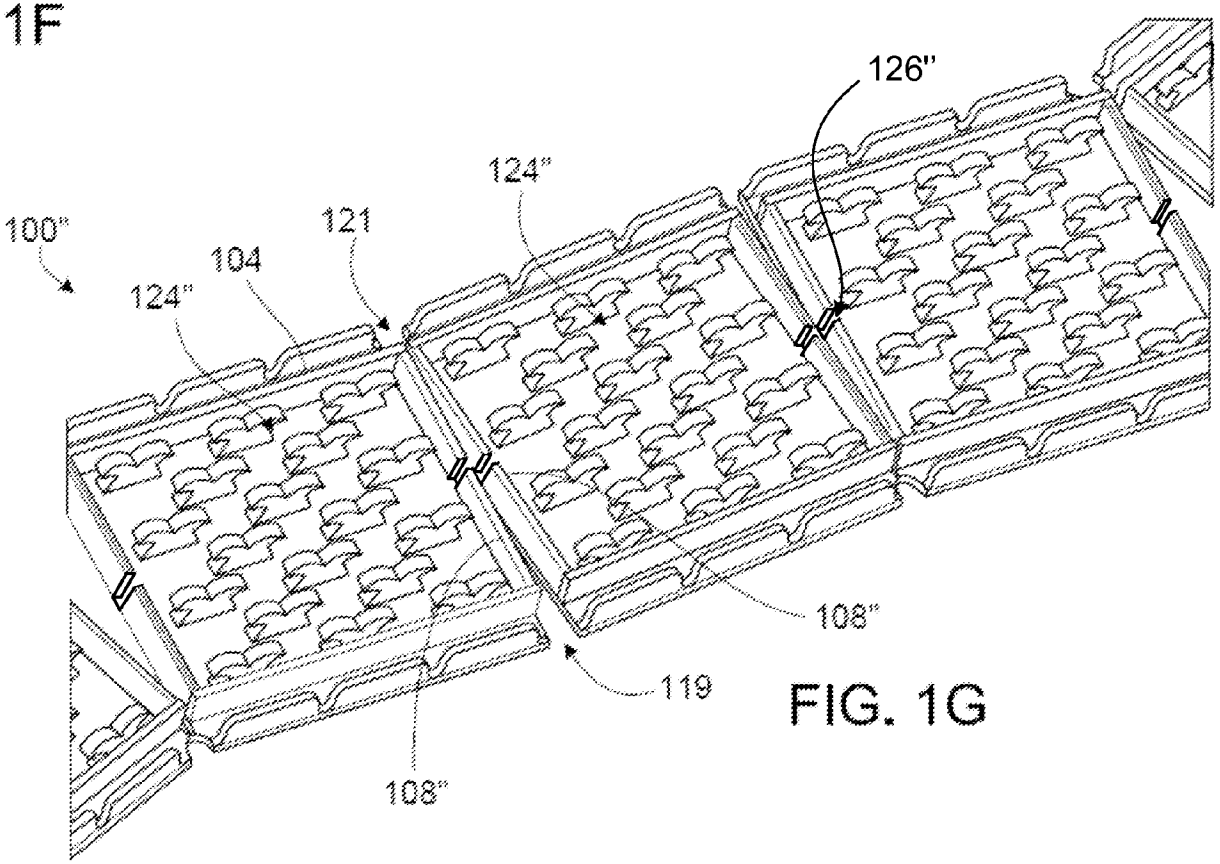
FIG. 1G is a perspective view of a first fastening product modified to accommodate lateral bending.

FIG. 1G shows yet another modified fastener product 100" designed to provide lateral flexibility. Fastener product 100" features a series of slits 119 formed between adjacent lateral walls 108" of each fastening cell 124", such that the lateral walls form direct barriers to foam flow when the product is placed in a mold with the slit opened as shown. In such cases, the gaps 126" are sized to permit only a limited amount of foam to intrude into each cell, so as to anchor the end of each cell in the foam while preventing the fouling of an excessive percentage of hooks within each cell. Slits 119 extend inward from one longitudinal edge of the base towards the opposing edge. In this example, slits 119 pass entirely through the barrier wall 104 near the opposing longitudinal edge of the base such that each fastening cell 124" is separated from any adjacent cell. As shown, each of slits 119 is paired with a small notch 121 at the opposing longitudinal edge. In this particular example, the notches are formed as a semi-circular indentation formed in the base material. However, it is appreciated the notches might also have other designs without departing from the scope of this disclosure. Together, notch 121 and slit 119 form a hinge point in the base material to accommodate lateral bending. The slit and notch pairs can be oriented on either longitudinal edge of the fastener product. In some examples, the series of slit and notch pairs are formed in a specific pattern (e.g., X number of pairs that allow bending from the left followed by X number of pairs that allow bending from the right. and so on). In some examples, all of the slit and notch pairs are oriented on the same longitudinal edge. Of course, the fastener product can be customized in this regard based on the desired application.

Figure 1H:
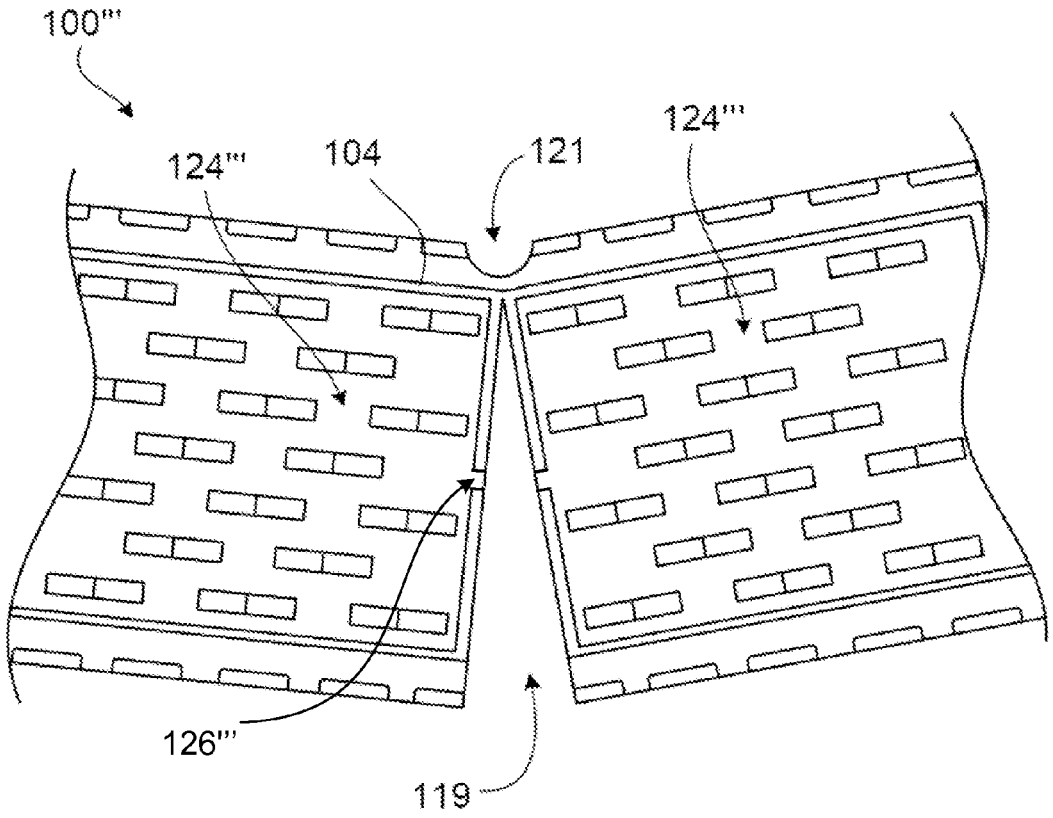
FIG. 1H is a top view of a first fastening product modified to accommodate lateral bending about a relatively strong hinge point.

FIG. 1H shows still another modified fastener product 100''' designed to provide lateral flexibility. Fastener product 100''' is similar to the previous example. However, in this case, slits 119 terminate at the barrier wall 104 near the opposing longitudinal edge of the base. Thus, in this example, adjacent fastening cells 124''' remain connected to one another by the barrier wall 104. This design can provide a stronger hinge point, including both the base material and that of the walls rising upward from the broad surface of the base.

Figure 1J:
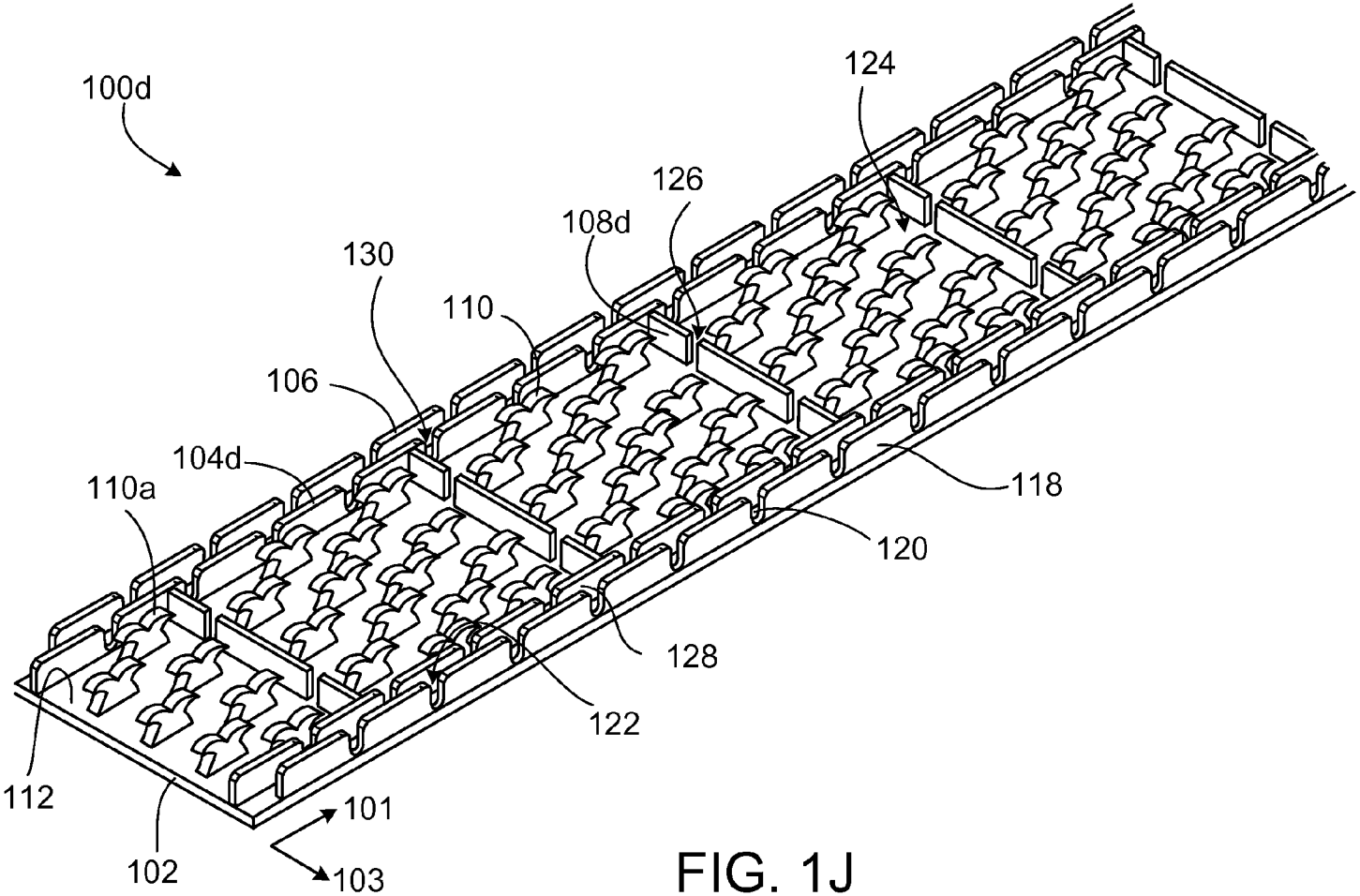
FIG. 1J is a perspective view of a first fastening product modified with longitudinal gaps along longitudinal walls.

FIG. 1J shows yet another modified fastener product 100*d* designed to provide longitudinal flexibility. Fastener product 100*d* features discontinuous barrier walls 104*d* that each include a longitudinal column of spaced-apart wall segments 128 defining longitudinal gaps 130 therebetween. The longitudinal gaps 130 of barrier walls 104*d* increase the longitudinal flexibility of the fastening product. Additionally, foam in foam relief spaces 122 may penetrate through the longitudinal gaps 130 and into fastener cells 124. In some cases, the longitudinal gaps 130 provide additional anchor points for holding the fastener product 100*d* to a molded foam article. However, in some cases, a large amount of foam in the fastener cells 124 may penetrate through the longitudinal gaps and contact the fastening elements 110. Thus, an appropriate width of the longitudinal gaps 130 is selected to balance the properties of flexibility, retention and foam resistance. In some examples, the longitudinal gaps have a maximum width along the longitudinal direction of the substrate. In a particular example, the maximum width of the longitudinal gaps is at least about 0.02 inch. In addition, the lateral walls can define multiple gaps, as discussed above. In this example, the lateral walls 108*d* each defines two gaps 126 therethrough.

Figure 1K:
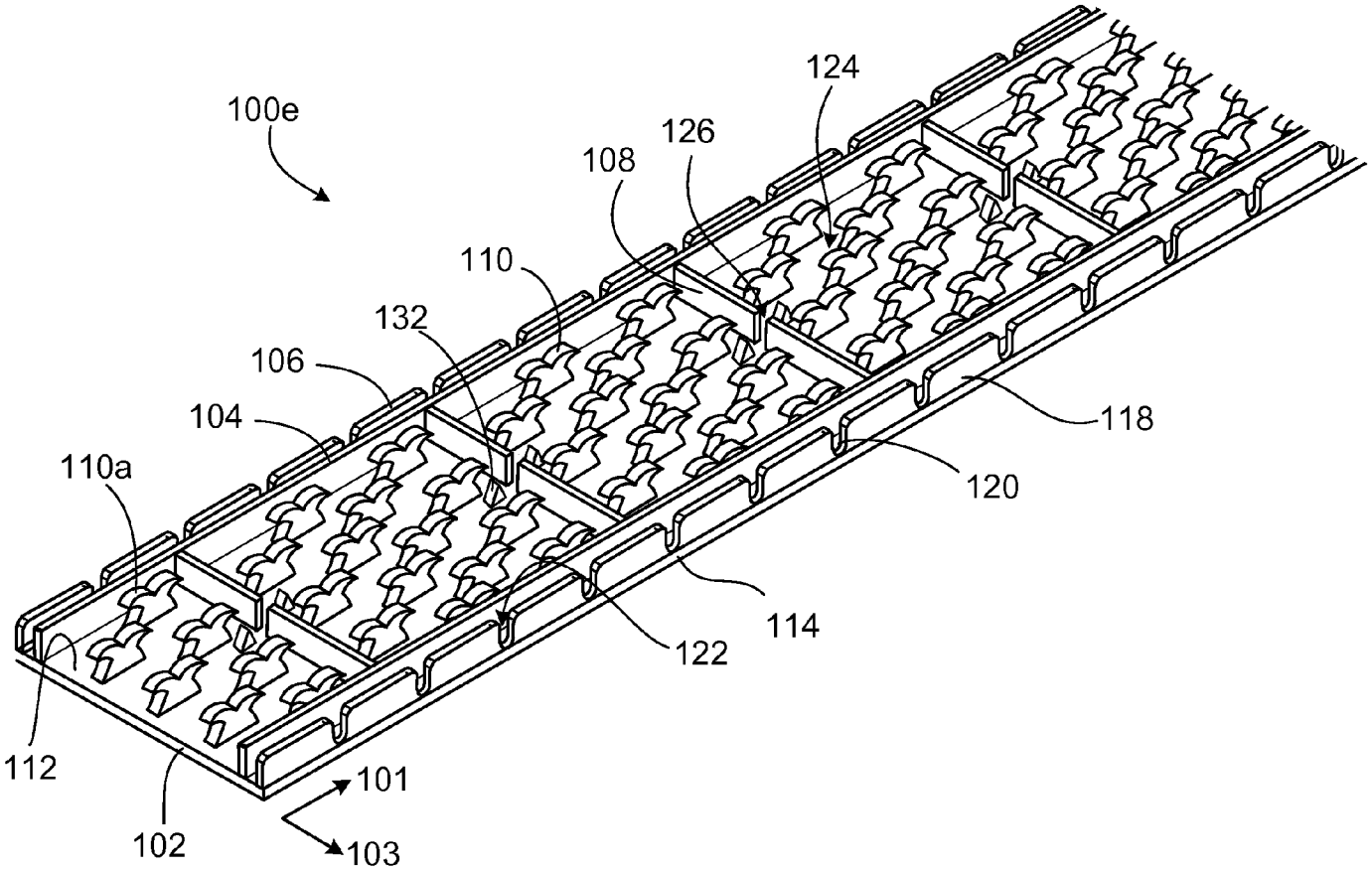
FIGS. 1K and 1L are perspective and top views of a first fastening product modified with disrupters adjacent gaps.
Figure 1L:
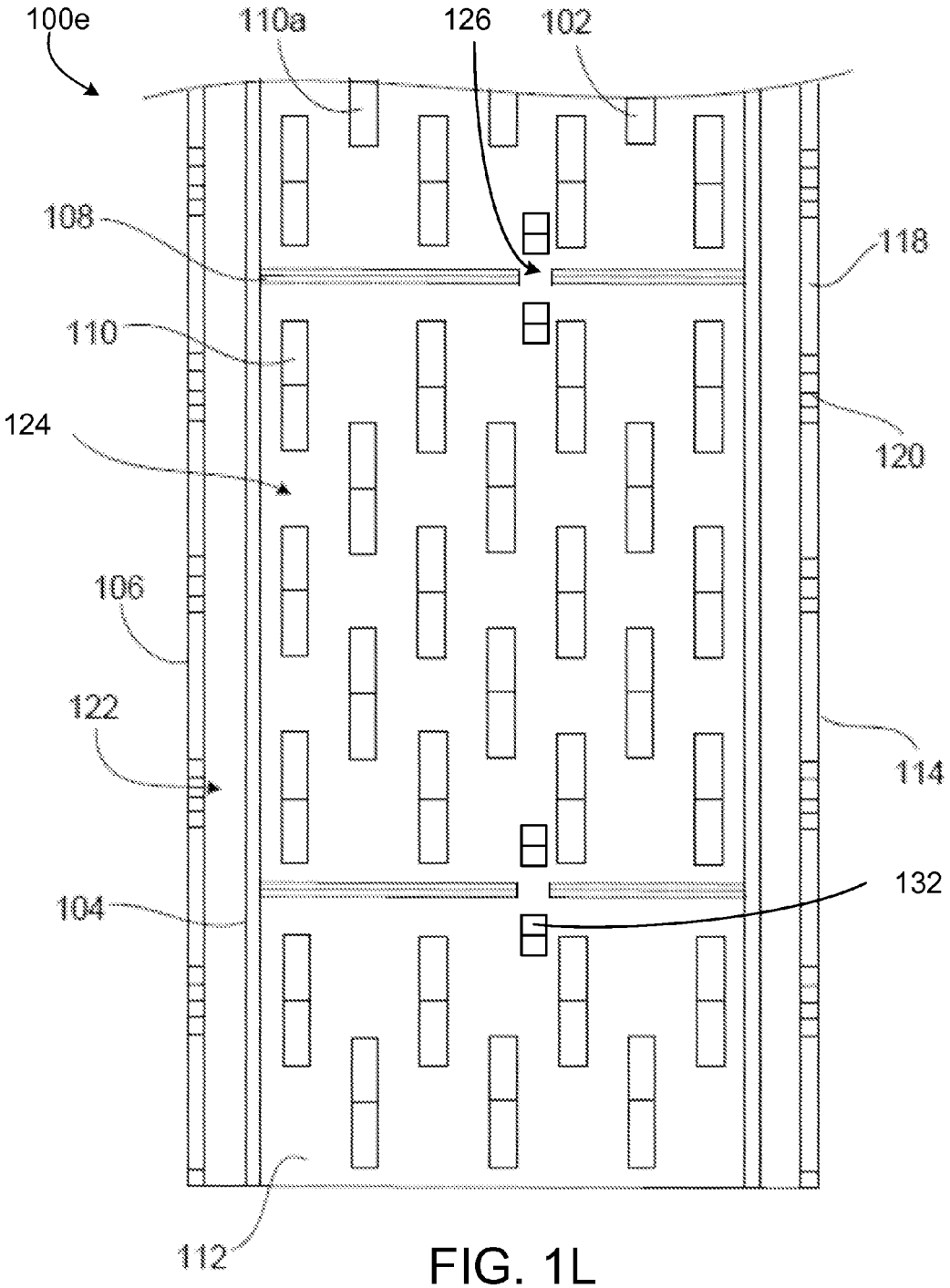

FIGS. 1K and 1L show perspective and top views of another modified fastening product designed to inhibit foam intrusion. Fastener product 100*e* is similar to fastener product 100. However, in this case, fastener product 100*e* includes foam disrupters 132 adjacent gaps 126 that extend through lateral walls 108. The foam disrupters 132 extend from upper surface 112 of the substrate 102 and within fastening cells 124 adjacent gaps 126. The foam disrupters 132 are configured to disturb the structure of foam entering the fastener cells 124 through gaps 126. The foam disrupters 132 are also configured not to affect air releasing through gaps 126.

In some examples, the foam disrupters 132 have a height less than a height of the lateral walls, e.g., about a half of the height of the lateral walls 108. In some other cases, the disruptors extend to the same height as the lateral walls. In some examples, the foam disrupters 132 extend, in a side profile, to distal points. In a particular example, the distal points define a point radius of less than 0.0015 inch. Each gap may have one or more adjacent foam disrupters. In this example, a pair of spaced-apart foam disrupters 132 is adjacent each gap 126 in a straight-line sequence. Other configurations of the foam disrupters can also be used.

Figure 1M:
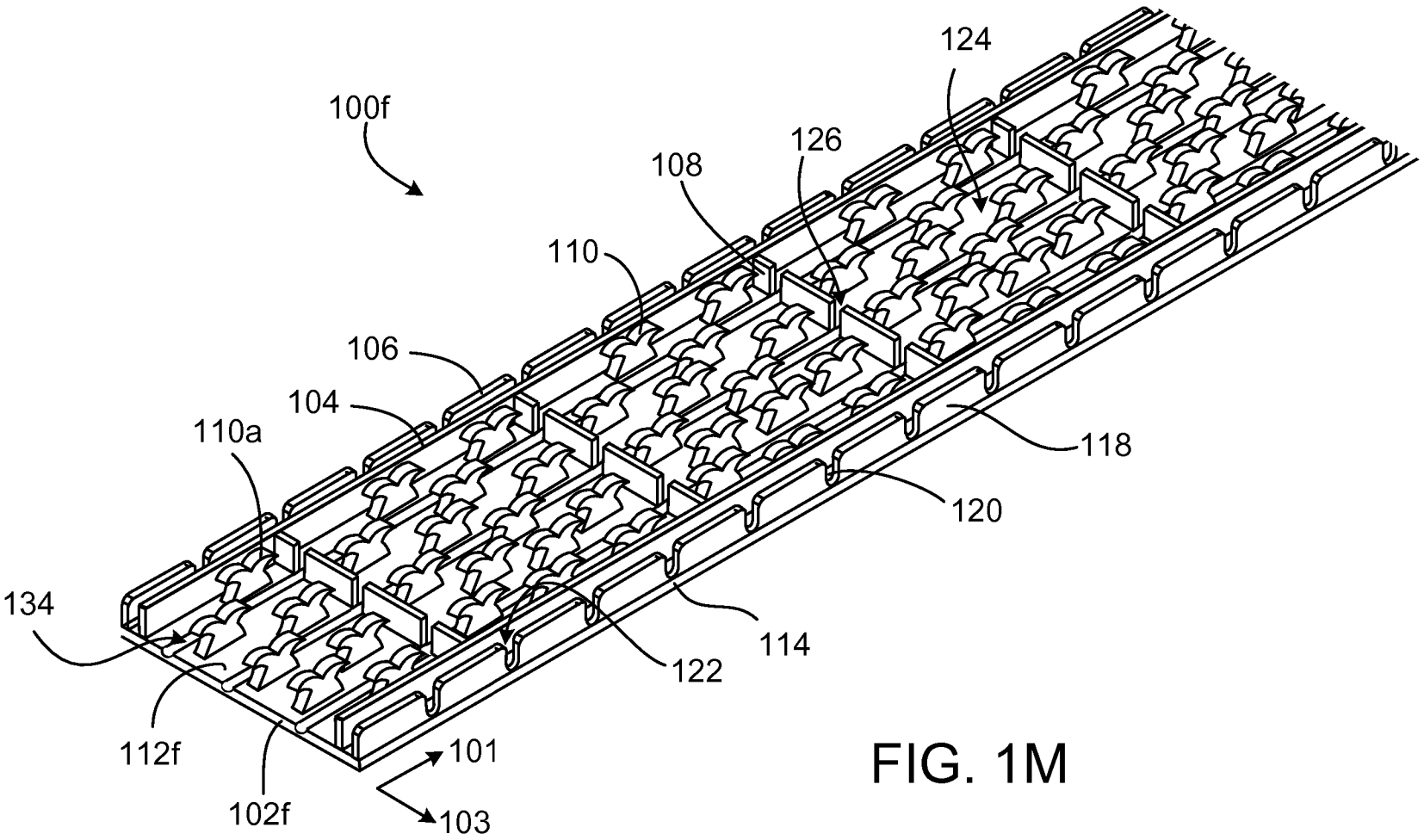
FIGS. 1M and 1N are perspective and top views of a first fastening product modified with longitudinal grooves.
Figure 1N:
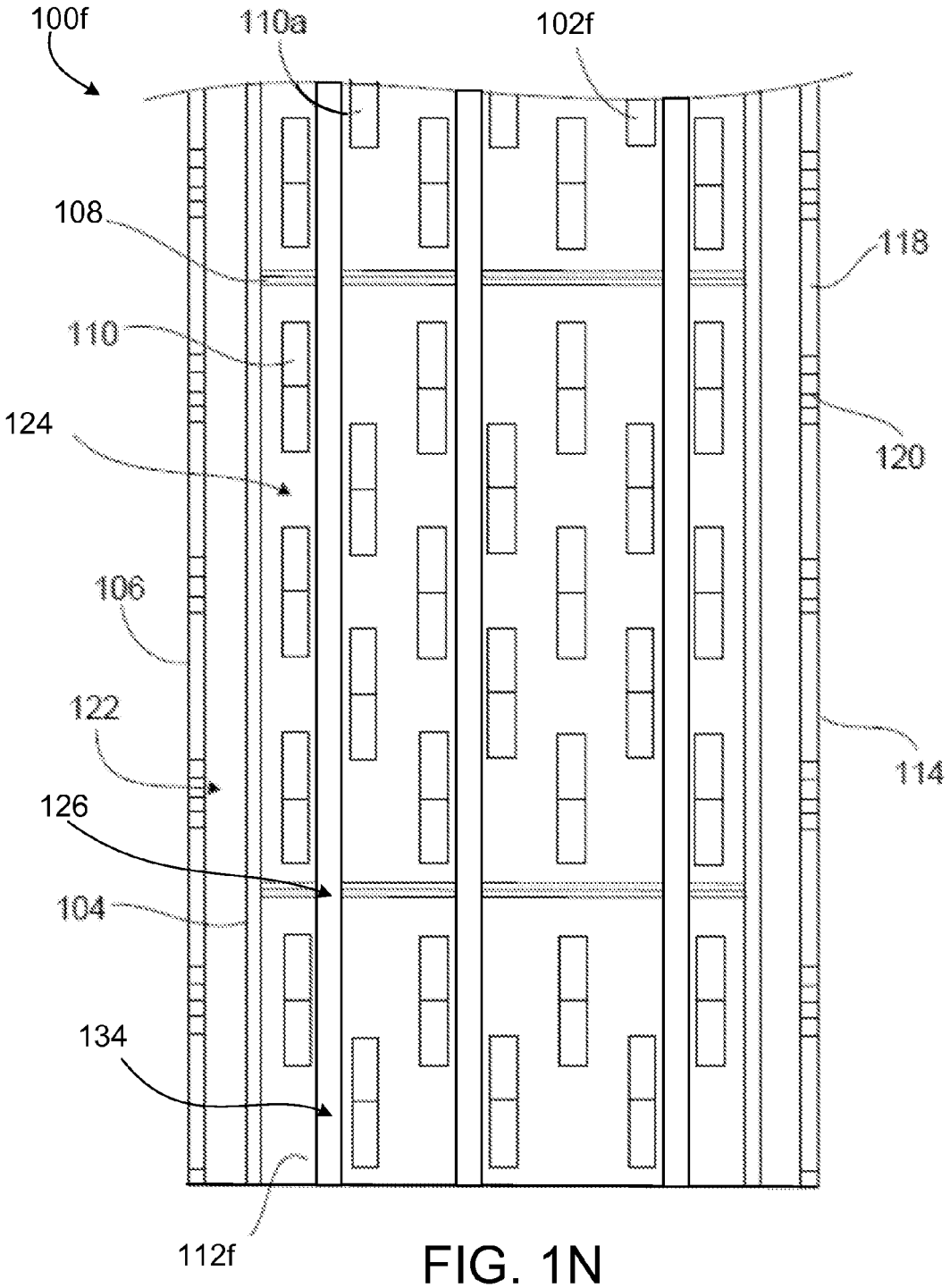
Figure 1Q:
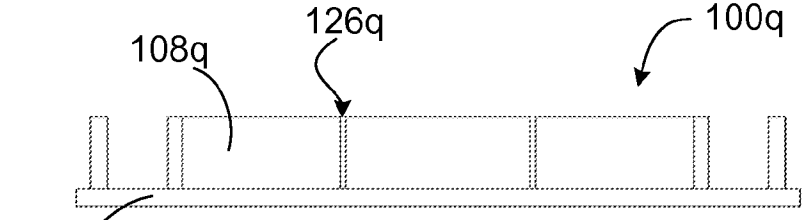
FIGS. 1P-1T are front views of a first fastening product modified with different gap configurations.
Figure 1R:
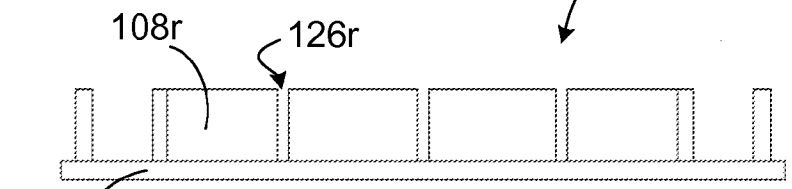

FIGS. 1M and 1N show perspective and top views of another fastener product designed to provide lateral flexibility. Fastener product 100*f* includes one or more longitudinal grooves 134 incorporated into the upper surface 112*f* of the substrate 102*f*. The longitudinal grooves 134 connect and form a lower extent of gaps 126 defined through lateral walls 108. In this example, grooves 134 are provided in the form of continuous indentations integrally molded with the substrate 102*f* and extend longitudinally along the length of the substrate, substantially parallel to the longitudinal walls 104 and segmented walls 106 of the fastening product. The substrate can have a thickness in the grooves of less than about 70 percent of a nominal thickness of the substrate on either side of the grooves. In some examples, the longitudinal grooves are at most about 0.008 inch deep. Other implementations of the grooves can also be used (e.g., perforations or folds in the substrate).

Longitudinal grooves 134 allow an outer portion the fastener product to flex relative to an inner portion. The degree of flexure is determined based on the material properties of the substrate and the dimensions of the grooves. In some examples, the grooves have a lateral width that is equal to a lateral width of the gaps 126 or a lateral width of the fastener elements 110. In a particular example, the grooves are about 0.013 inch wide, and about 0.0065 inch deep. In some cases, the grooves have sharp corners and flat bottoms. In some other cases, the grooves have curved bottom surfaces, and may form a portion of a cylinder.

FIGS. 1P-1T show front views of fastener products with different gap configurations. Fastener products 100*p*, 100*q*, 100*s*, 100*r*, and 100*t* each are similar to fastener product 100, however, lateral walls of these fastener products define different gaps extending therethrough. In some cases, a fastener product may include one or more features described in the different gap configurations.

Figure 1P:
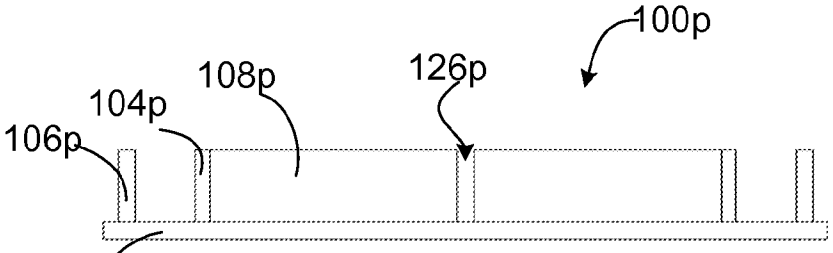
Figure 1S:
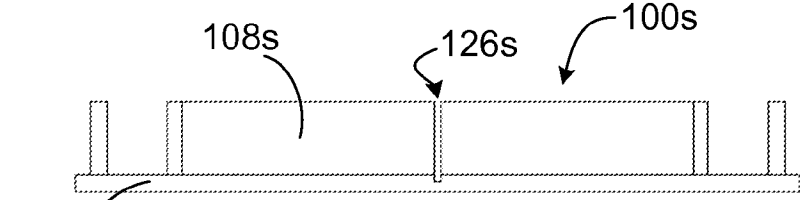

For fastener product 100*p*, as shown in FIG. 1P, each lateral wall 108*p* defines one gap 126*p*. The gap 126*p* can have a constant lateral width, extending from upper surface of the substrate 102*p* through an upper extent of the lateral wall 108*p*. In a particular example, the lateral width is about 0.012 inch. For fastener product 100*q*, each lateral wall 108*q* defines two gaps 126*q* therethrough that are spaced apart laterally. In a particular example, each gap 126*q* defines a lateral width of about 0.004 inch. Fastener product 100*r* features three spaced-apart gaps 126*r* extending through each lateral wall 108*r*. In a particular example, each gap 126*r* defines a lateral width of about 0.008 inch.

In some implementations, gaps may extend into the substrate. For example, for fastener product 100*s*, lateral walls 108*s* extend from upper surface of the substrate 102*s*, while gap 126*s* extends from a position below the upper surface and within the substrate 102*s*. In a particular example, the substrate has a thickness of about 0.012 inch, and the gap 126*s* extends downwardly into the substrate about 0.005 inch.

Figure 1T:
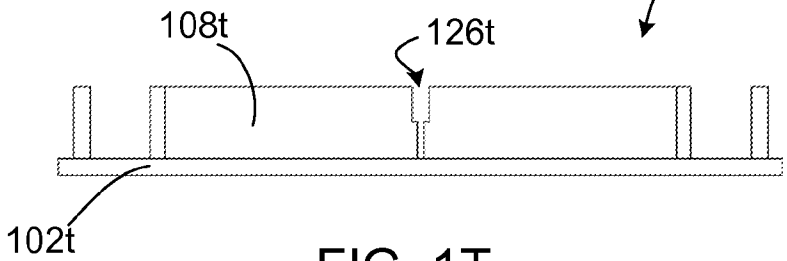

In some implementations, the gaps can be configured to vary with distance from upper surface of the substrate. For example, the gaps may be wider at their distal extent than at a height closer to upper surface of the substrate. As shown in FIG. 1T, gap 126*t* extends from upper surface of the substrate 102*t* to a middle position of the lateral wall 108*t* with a first lateral width, and then to the upper extent of the lateral wall 108*t* with a second lateral width that is wider than the first lateral width. In a particular example, the first and second lateral widths are 0.004 inch and 0.012 inch, respectively.

The transverse wall gaps in various transverse walls of the product need not be laterally aligned. Laterally aligned gaps may be formed by molding about a common ring of a molding roll, but gaps in different transverse walls can be formed by different rings, such that the gaps of different transverse walls are differently spaced from a longitudinal edge of the product. Such purposeful misalignment may be useful, for example, in tailoring flexure resistance of the product along its length.

Figure 2A:
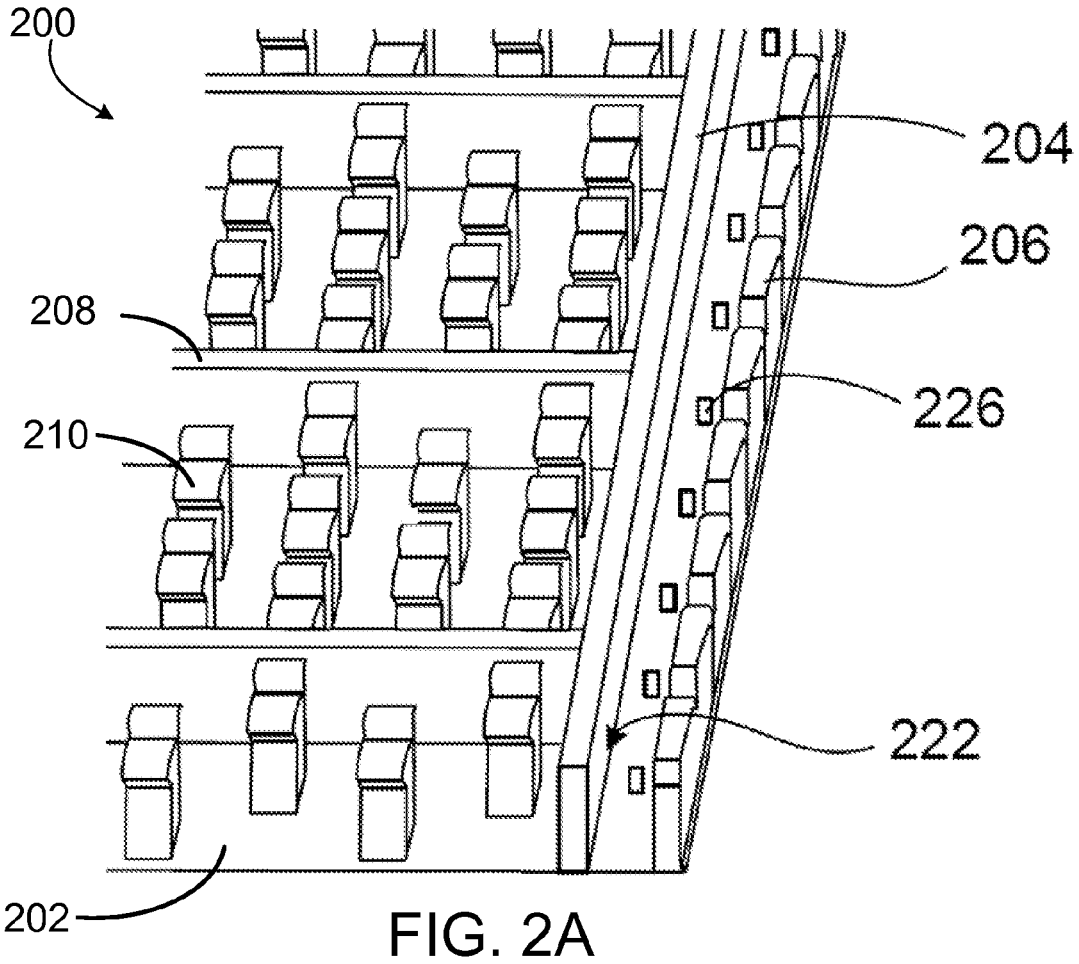
FIGS. 2A and 2B are perspective and side views of a second fastening product.
Figure 2B:
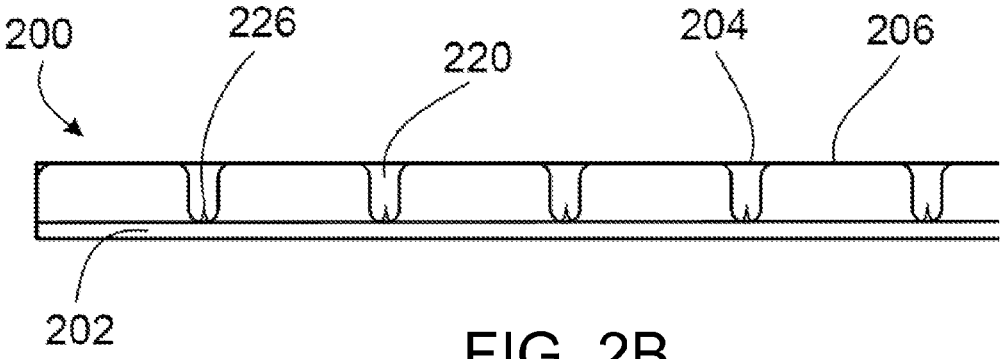

Referring to FIGS. 2A and 2B, another example fastener product 200 includes foam disrupters 226. Fastener product 200 is similar in its configuration to fastener product 100. For example, fastener product 200 includes a substrate 202, barrier walls 204, segmented walls 206, lateral walls 208, and fastener elements 210. Foam disrupters 226 are located within foam relief spaces 222. In this example, the foam disrupters 226 extend from the upper surface of substrate 202. In some other examples, however, foam disrupters can additionally, or alternatively, extend from facing surfaces of a segmented wall and/or its nearest longitudinal wall.

As shown, foam disrupters 226 are arranged in a straight-line longitudinal sequence, such that each of the foam disrupters is spaced apart from any neighboring foam disrupters by a constant interval. Further, in this example, foam disrupters 226 are aligned with each of longitudinal gaps 220. As such, the foam disrupters can contact incoming foam before the foam sets-up (e.g., while the foam is still at least partially liquefied) and cannot be effectively disrupted. Other configurations of the foam disrupters can also be used, however. For example, additional foam disrupters that are not aligned with the longitudinal gaps can be provided. Further, in some implementations, the density of foam disrupters per unit strip length of the substrate varies. For instance, a first length of the substrate can be provided with more or less foam disrupters than a second length. In this example, the foam disrupters are provided in the form of small molded spikes or barbs having the shape of a triangular prism. However, other types of foam disrupters can also be used (e.g., upstanding stems or prongs). The height of the foam disrupters is at most equal to that of the fastening elements.

Foam disrupters 226 are configured to disturb the structure of foam entering the foam relief spaces. For example, the foam disrupters can collapse the foam by breaking foam bubbles. Collapsing foam entering foam relief spaces 222 increases the foam's density. As a result, the strength the foam is increased while its expansion ratio is decreased. Accordingly, providing an appropriate configuration of foam disrupters 226 allows the foam passing through the flow gaps of segmented walls 206 to expand and set-up in foam relief spaces 222, without exerting excessive force on fastening product 200. As noted above, in some cases, expansion of the foam can exert sufficient force to urge the fastening product away from the flat surface of a mold pedestal surface, allowing foam to enter into the interior of the fastening cells. Foam disrupters 226 can also serve as additional anchor points holding the fastener product to a molded article when the foam cures or sets up in the foam relief spaces.

In a particular example, each of the foam disrupters extends from the upper surface of the substrate to a height of 0.012 inch, and widthwise (i.e., in the lateral direction of the substrate) to 0.006 inch. The foam disrupters are disposed within the foam relief spaces at a constant longitudinal distance interval of about 0.154 inch.

Other implementations of the foam disrupters can also be used. For example, the foam disrupters can be provided in the form of a surface roughness (e.g., foam disrupters with a height between about 1 and 100 nanometers) applied to one or more of the walls delimiting the foam relief spaces. In some examples, the foam disrupters are placed at random within the foam relief spaces, such that no discernable pattern or sequence is achieved. In some examples, the foam disrupters can have various appropriate sizes and shapes.

Figure 3:
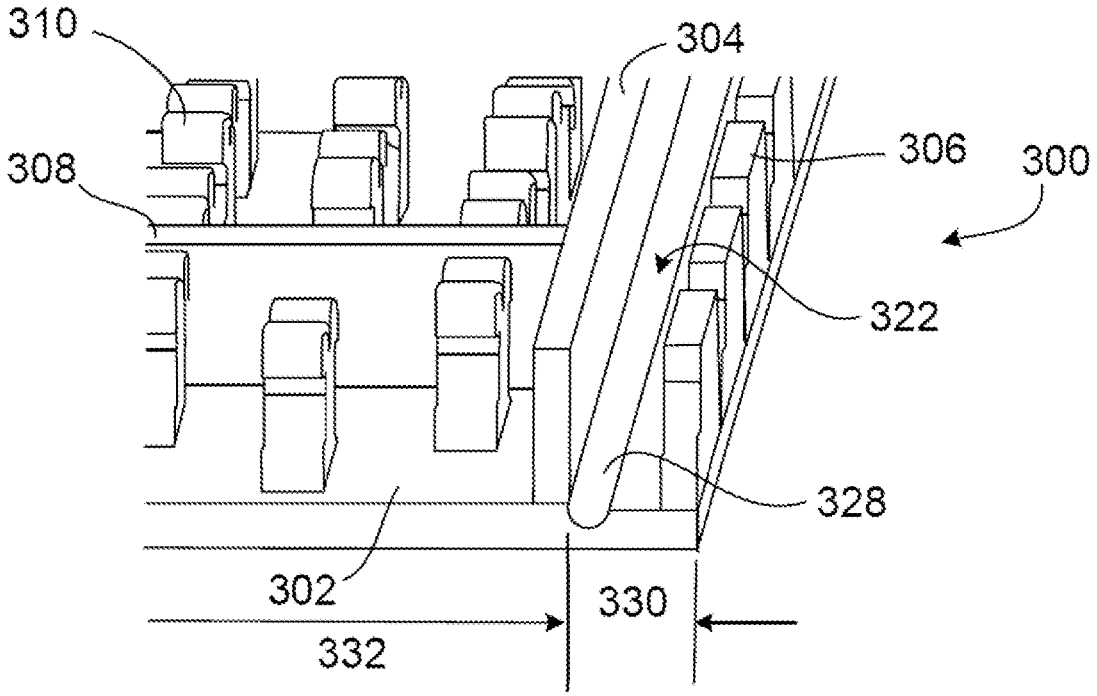
FIG. 3 is a perspective view of a third fastening product.

Referring to FIG. 3, another example fastener product 300 includes hinges 328. Fastener product 300 is similar in its configuration to fastener product 100. For example, fastener product 300 includes a substrate 302, barrier walls 304, segmented walls 306, lateral walls 308, and fastener elements 310. Hinges 328 are incorporated into the upper surface of substrate 302 within foam relief spaces 322. In this example, hinges 328 are provided in the form of continuous indentations integrally molded with the substrate 302 and positioned just outboard of barrier walls 304. In some examples, the hinges are at most about 0.008 inch deep. Other implementations of the hinges can also be used (e.g., perforations or folds in the substrate).

Hinges 328 can allow outer portions 330 (e.g., the portions of the fastener product outboard of the hinges) of the fastener product to flex relative to an inner portion 332. The degree of flexure is determined based on the material properties of the base substrate and the dimensions of the hinges. In a particular example, the hinges are 0.013 inch wide, and about 0.0065 inch deep. Allowing the outer edge portions to flex relative to the inner portion of the fastener can reduce stress near the longitudinal edges of the substrate. These stresses can result from various operations in forming the molded foam article. For example, in molding the article, stress is imparted on the fastening product near its longitudinal edges when foam expands in the foam relief spaces. High stress also occurs during other common processes such as de-molding and roller crushing. When the fastener product is secured to the molded product, the hinges allow the outer portions to move with the cured foam. As a result, crack formation and propagation near the longitudinal edges is inhibited.

As shown, hinges 328 extend longitudinally along the length of the substrate, substantially parallel to the barrier walls and segmented walls of the fastening product. However, in some examples, the fastening product can include lateral hinges that traverse the width of the fastener product. The lateral hinges can be incorporated into the backside surface of the substrate 302, and disposed at predetermined intervals down the substrate's length. Incorporating lateral hinges into the fastening product can increase flexibility in the longitudinal direction, such that the fastening product is more suited for winding about a take-up roll and forming a continuous spool.

Figure 4A:
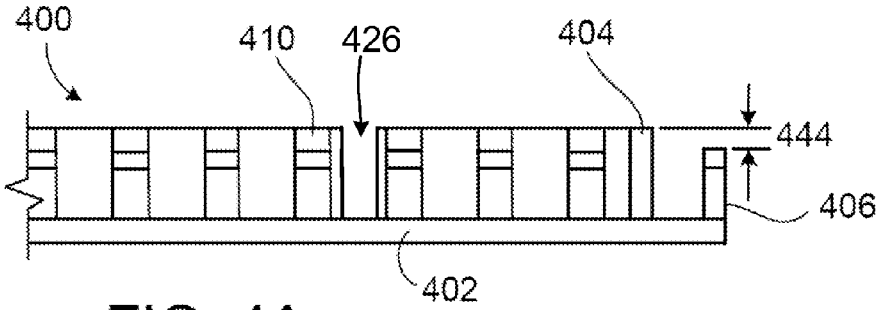
FIGS. 4A-4C are front, side, and perspective views of a fourth fastening product.
Figure 4B:
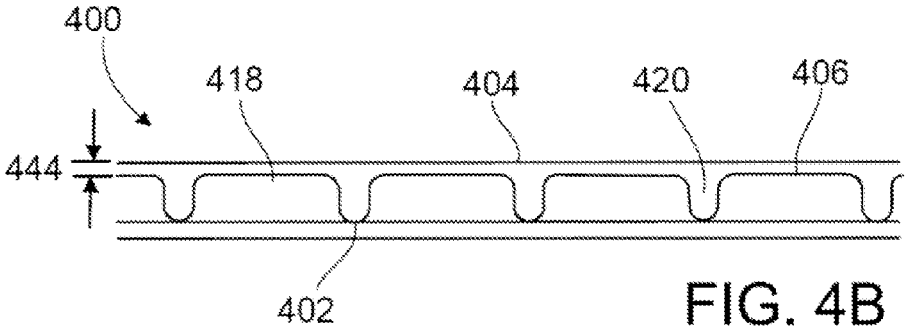
Figure 4C:
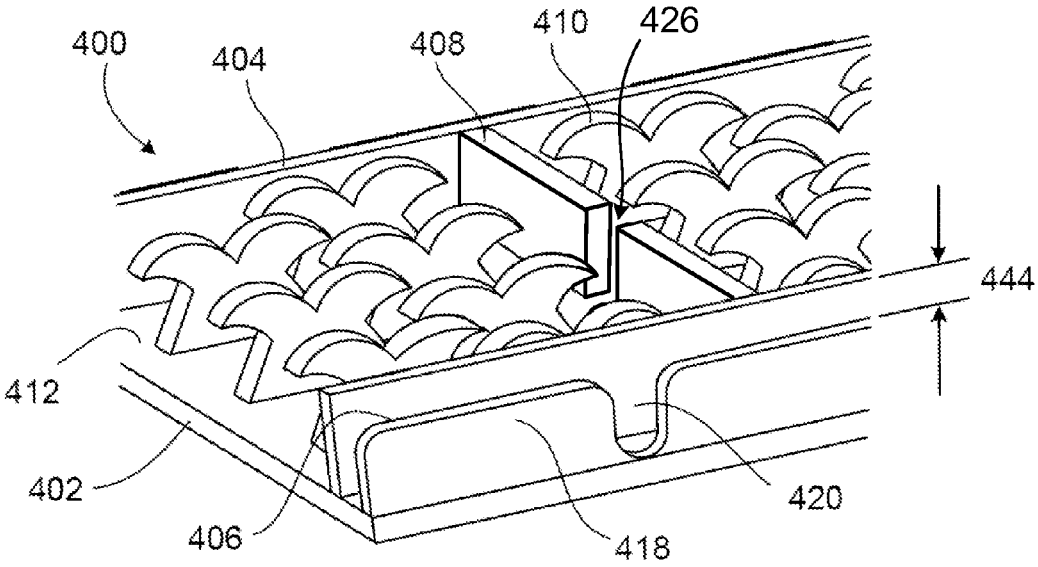

Referring to FIGS. 4A-4C, another example fastener product 400 has an augmented flow gap. Fastener product 400 is similar in its configuration to fastener product 100. For example, fastener product 400 includes a substrate 402, barrier walls 404, segmented walls 406, lateral walls 408, and fastener elements 410. Lateral walls 408 each define a gap 426 therethrough. In this example, wall segments 418 extend from the upper surface of substrate 402 to a height that is significantly lesser than that of barrier walls 404. For example, the height of the wall segments is substantially less than the height of the barrier walls (e.g., at least 0.004 inch shorter). In a particular example, the difference in height between the wall segments and the barrier walls is about 0.011 inch. As shown, the height difference provides additional flow openings 444 for foam to enter the foam relief spaces. Accordingly, the flow gap of each segmented wall 406 includes the open area provided by both flow openings 444 and longitudinal gaps 420. Although, in the illustrated examples, each of the wall segments are the same height, other implementations exist where each of the wall segments has a respective height (for example, some wall segments will be taller or shorter than other wall segments).

Figure 5B:
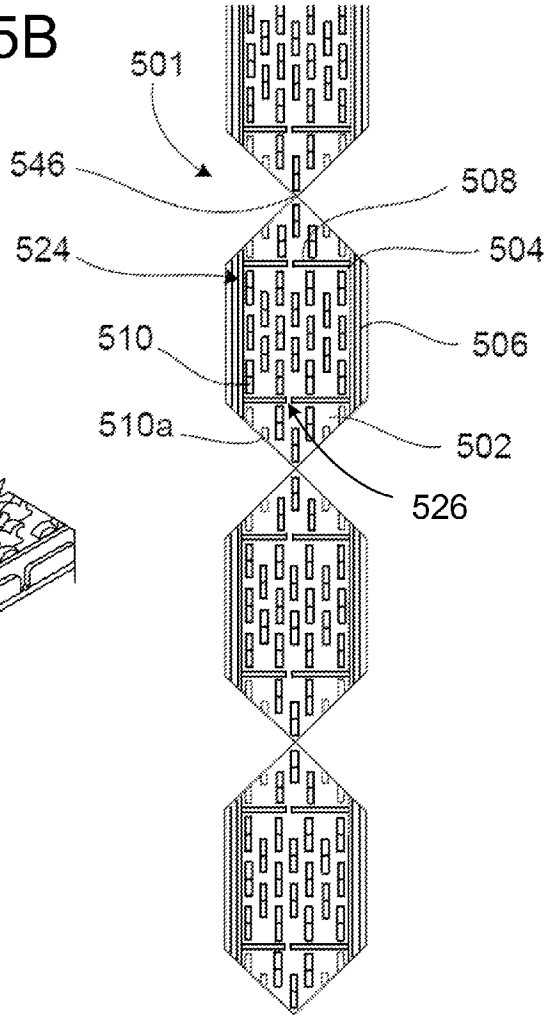
FIGS. 5A and 5B are perspective and top views of a fifth fastening product.
Figure 5A:
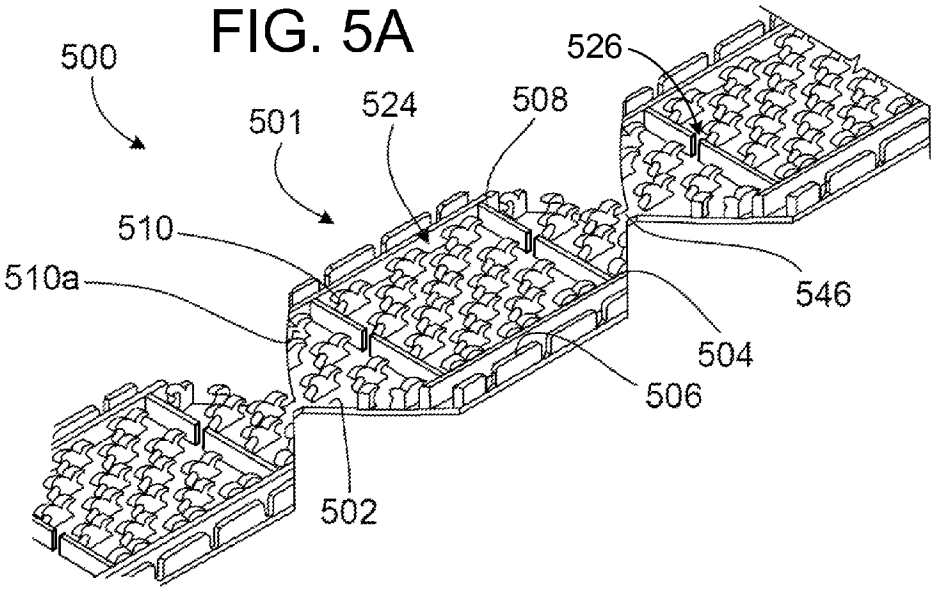

Referring to FIGS. 5A-5C, another example fastener product 500 includes a chain of multiple fastening segments 501. Each of the fastening segments includes a substrate 502, barrier walls 504, segmented walls 506, lateral walls 508, and fastener elements 510 and 510*a*. Each lateral wall 508 defines at least one gap 526 therethrough. Fastener segments 501 are connected to one another by a flexible neck 546. More particularly, in this example, the flexible neck connects the base substrates of neighboring fastener segments to one another. As shown, the width of the flexible neck is less than the width of each segment. In some examples, the flexible neck can be flexible around three orthogonal axes. Accordingly, the flexible neck 546 can allow connected fastening units to move relative to one another.

As shown, the barrier walls 504 and lateral walls 508 of each segment 501 define a fastener cell 524 which seals fastener elements 510 from contact with foam material during a molding process. Fastener elements 510*a*, which are disposed outside of fastener cells 524, remain exposed during the molding process. As such, when fastener product 500 is held against a mold pedestal, flowing foam is allowed to contact and surround fastener elements 510*a*, but not fastener members 510. Therefore, fastener elements 510*a* can act as anchor points for securing fastener product 500 to a molded foam article, while fastener elements 510 remain available for engagement to a mating fastening component. Additionally, flowing foam may pass through gaps 526 and into fastener cells 524. In this case, the gaps 526 can be configured to be small enough such that only a small amount of foam passes into fastener cells but is inhibited from contacting fastener elements 510. With solidified foam, the gaps 526 can act as additional anchor points for better holding fastener product 500 to the molded foam article.

In some examples, the barrier walls and segmented walls of each fastening segment provide foam relief spaces that are appropriately dimensioned based on a foam relief ratio (as described above). In some examples, each of the fastening segments includes multiple foam disrupters positioned within the foam relief spaces (as described above). The foam disrupters can be configured to disturb the structure of foam entering the foam relief spaces. In some examples, each of the fastening segments includes hinges positioned in the foam relief spaces (as described above) that allow outer portions of the fastener product to flex relative to an inner portion.

The fastening products described above may be used in a variety of fastening applications. For example, in addition to conventional foam molding applications, the arrangements of the fastening elements and walls can also be employed on a rigid fastening surface, such as injection molded fastening products. The following description provides details of an example application of a fastening product having the types of configurations discussed above.

Figure 6A:
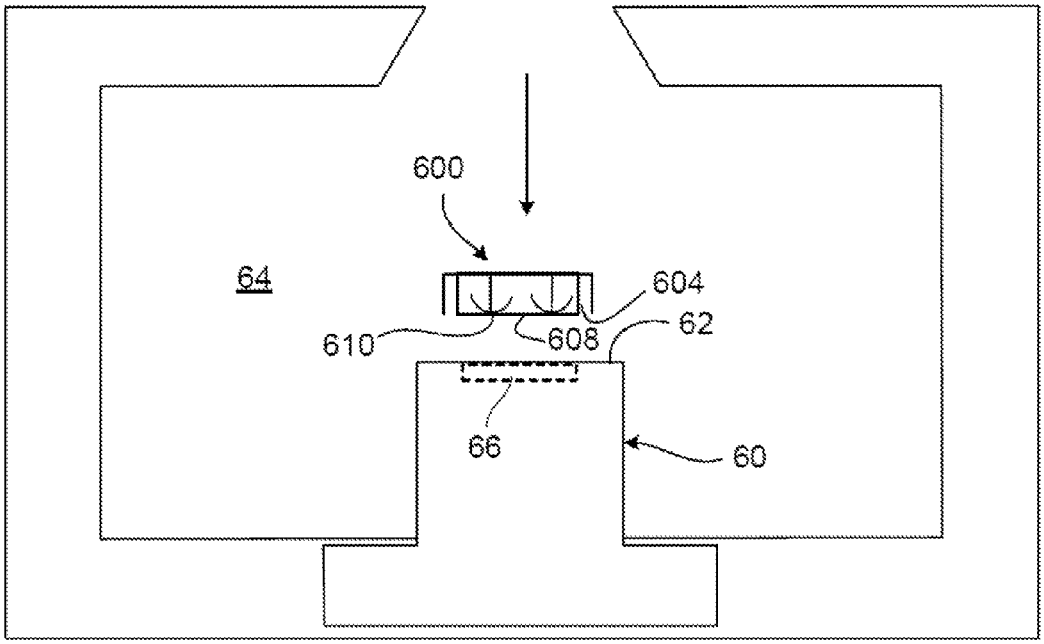
FIGS. 6A-6D schematically and sequentially illustrate a process for forming a molded foam article with a fastening product embedded in one surface of the article.
Figure 6B:
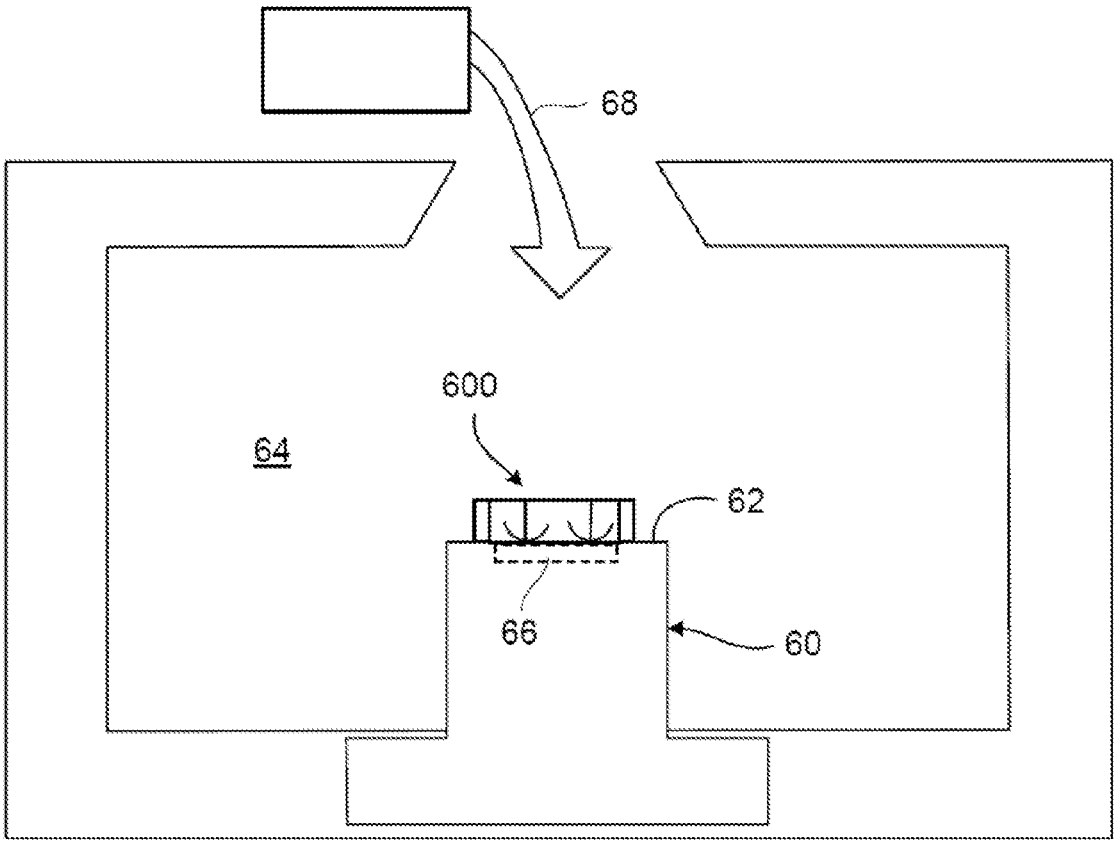

As shown in FIG. 6A, fastener product 600 is placed on a flat surface 62 of a mold pedestal 60. Mold pedestal 60 is disposed in the interior space of a mold cavity 64. Fastener elements 610 of the product face the mold pedestal surface. As described above, the fastener elements are arranged on the surface of the supporting substrate in arrays bounded by the walls of neighboring fastener cells (i.e., the barrier walls 604 and lateral walls 608). As shown in FIG. 6B, fastener product 600 is held against flat surface 62 by an embedded magnet 66 that attracts the fastener product. Magnetic attraction may be due to magnetically attractable resin forming all or part of the fastener product, or may be due to some other magnetically attractable material (e.g., a metal shim or mesh that is secured to or embedded in the substrate of the product).

Figure 6C:
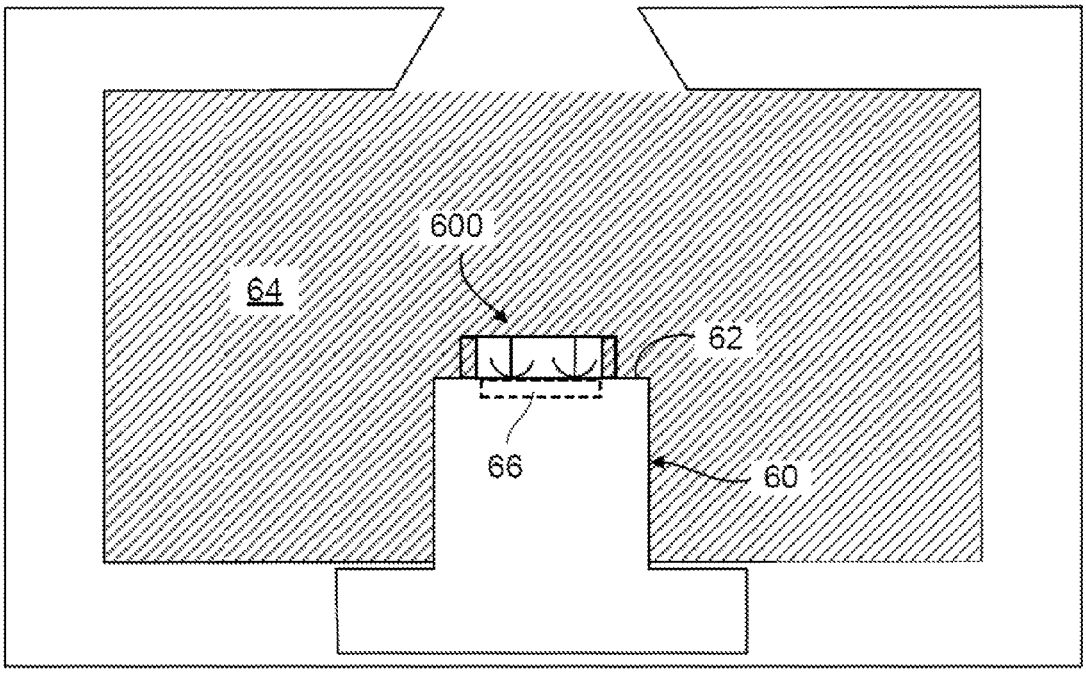

Referring to FIG. 6B, liquid foam resin 68 is introduced into the mold cavity 64. Liquid foam 68 may constitute a single component, or there may be multiple components that are mixed as they are introduced into the mold cavity, or before. In some implementations, polymeric foams (e.g., polyurethane foam, latex foam, and the like) are used. As shown in FIG. 6C, the liquid foam expands to fill the mold cavity. In some examples, the mold cavity can include a number of vents (now shown) to allow gas displaced by the expanding foam to exit the mold cavity. Suitable venting arrangements for the mold cavity are disclosed in U.S. Pat. Nos. 5,587,183 and 7,878,785.

As the liquid foam fills the mold cavity, the foam is allowed to pass through segmented walls in the fastening product and enter appropriately dimensioned foam relief spaces. The foam relief spaces allow the foam to expand without forcing the fastener product away from the mold pedestal surface. In some cases, a limited amount of foam also flows into the gaps within the lateral walls bordering fastening cells near the ends of the products. The walls of the fastening cells rest against the flat pedestal surface, effectively preventing excessive fouling of the fastening elements.

Figure 6D:
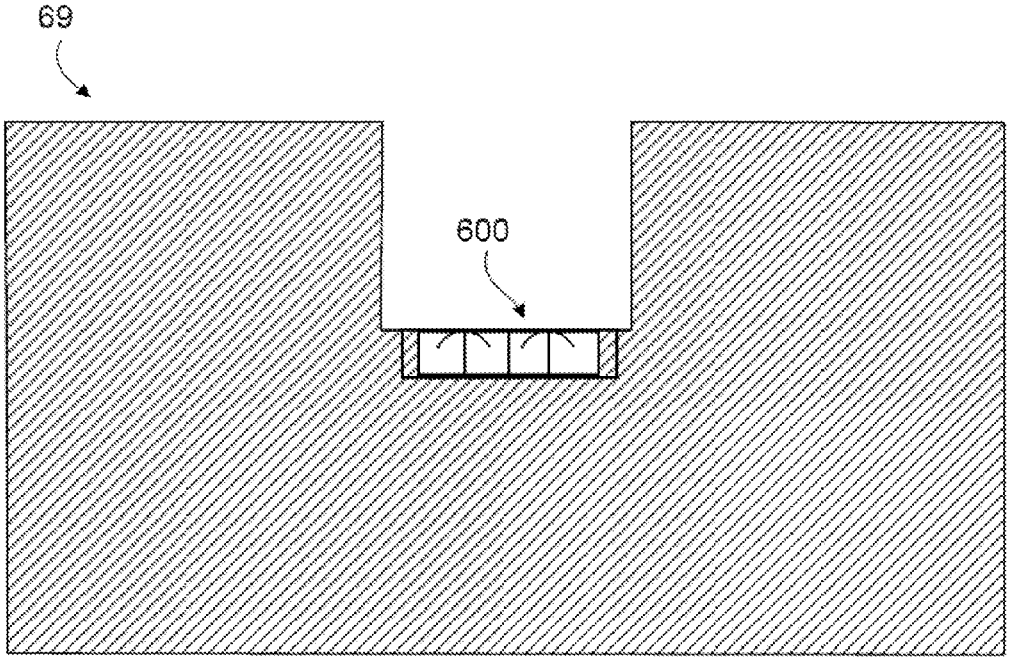

Referring to FIG. 6D, a molded foam article 69, as removed from the mold cavity, has fastening product 600 embedded in a trench defined by the mold pedestal. The perimeter of the fastener product is surrounded by foam. Foam also occupies the foam relief spaces, anchoring fastening product 600 to the foam article 69. The barrier walls and lateral walls of the fastening product form flow barriers to inhibit, if not prevent, foam from contacting the interior fastening elements. As a result, the fastener elements remain exposed and functional to releasably engage with fibers of a mating component (not shown) to form a hook-and-loop fastening.

Other appropriate molding techniques and apparatus can be used to form a molded article with an incorporated fastener product. For instance, in some examples, the fastening product can be placed directly on a surface of the mold (e.g., in a trench of the mold), as opposed to the mold pedestal surface shown and described herein.

Figure 7:
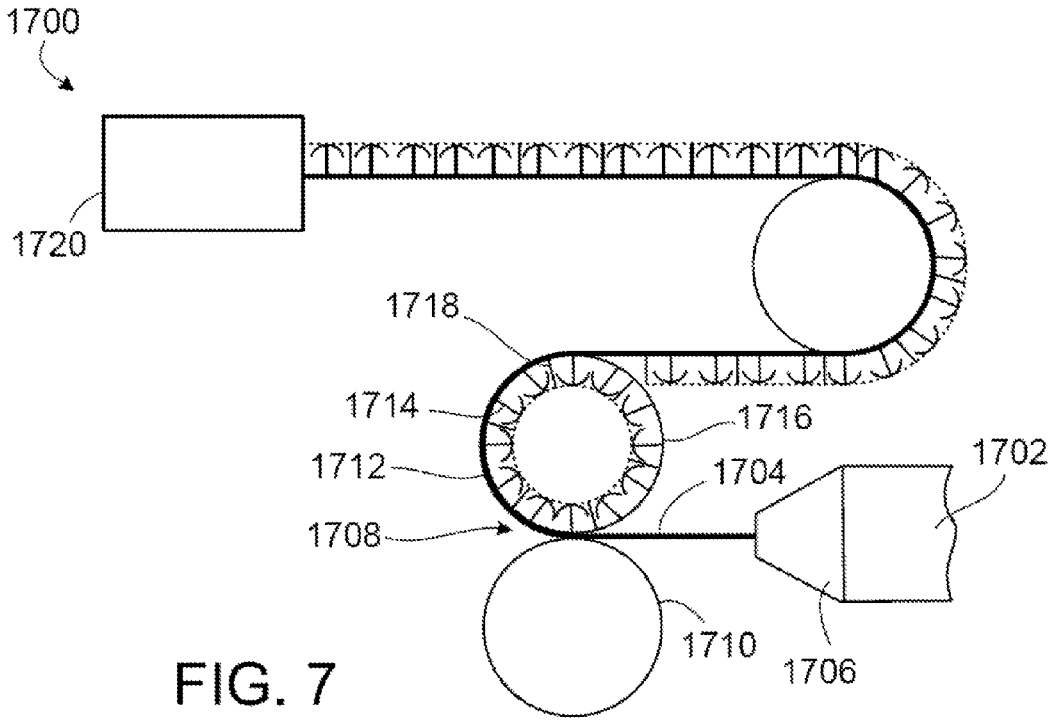
FIG. 7 is a side view of an apparatus for forming a fastening product.

The fastener products disclosed herein can be formed as flexible, continuous strips or sheets of material in a continuous roll molding process. Referring to FIG. 7, manufacturing apparatus 1700 has an extruder barrel 1702 that melts and forces a molten resin 1704 through a die 1706 and into a nip 1708 between a pressure roller 1710 and a cavity roller 1712. Cavity roller 1712 has cavities 1714 defined about its perimeter 1716 that are shaped to form the fastener elements of the product, and other cavities 1718 that are configured to form the walls of the product, as the base substrate is formed on the outer surface of the cavity roller. In many cases, the outer surface of the cavity roller is formed by a stacked set of concentric, thin plates, as taught, for example, by Fischer in U.S. Pat. No. 4,775,310.

Pressure in the nip forces the molten resin into the various cavities, leaving some resin remaining on the cavity roller surface. The resin travels around the cavity roller, which is chilled to promote resin solidification, and the solidified product is then stripped from the cavity roller by pulling the solidified fastener elements and walls from their respective cavities. The fastener elements, walls and their respective cavities are illustrated schematically and are not to scale. In many cases the cavity roller will be of a diameter of between 30 and 50 centimeters, and the fastener elements and walls will be less than 1.5 millimeter in height (as described above), to give a sense of perspective.

After the continuous length of fastening material is formed, it moves through a die-cutting station 1720, where discrete fastener products are sequentially severed from the material. The remaining fastener material may be discarded or, in some cases, ground up and recycled to make further material.

Figure 8:
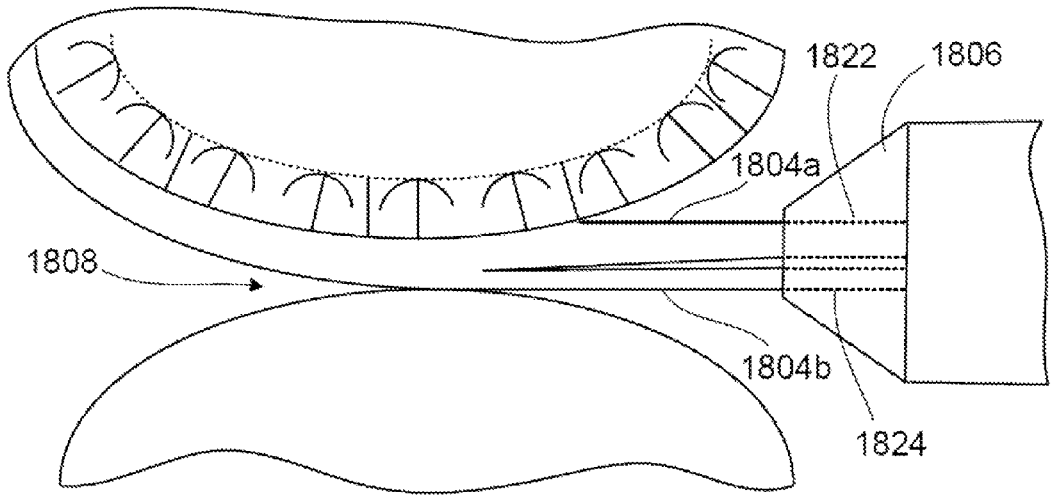
FIG. 8 is a side view of an apparatus for forming a fastening product as a coextrusion.

Referring to FIG. 8, the apparatus and process of FIG. 7 may be modified to mold the fastening product from multiple resins, by extruding two molten resins together into the nip. In this example, a sufficient amount of a molten resin 1804*a* is extruded into nip 1808 to form the walls and fastener elements of the fastener product, while another flow of molten resin 1804*b* is introduced to the nip to form the base substrate of the product. The two resins are forced through a cross-head die head 1806 with two different die orifices 1822 and 1824, to join in the nip. A respective pool of each of the resins forms just upstream of the nip. In the nip, resin 1804*a* is forced into the cavity roller to form the fastener elements and the walls, while resin 1804*b* is calendered to form the substrate. The pressure in the nip also permanently laminates resin 1804*a* with resin 1804*b* to form the finished fastener product. In one example, resin 1804*b* is a magnetically attractable resin, while resin 1804*a* is a resin selected for wall and/or fastener element performance. In another example, the amount of each resin flow is modified such that the amount of resin 1804*a* is sufficient only to fill the head portions of the fastener element cavities and the inner extents of the wall-forming cavities, and is selected to have a lower durometer to provide the finished product with a softer feel and to enhance sealing of the upper wall surfaces against a foaming mold surface. In another example, the amount of each resin flow is adjusted such that resin 1804*a* fills the cavities and forms the upper surface of the substrate, with resin 1804*b* forming only the back portion of the substrate.

Figure 9B:
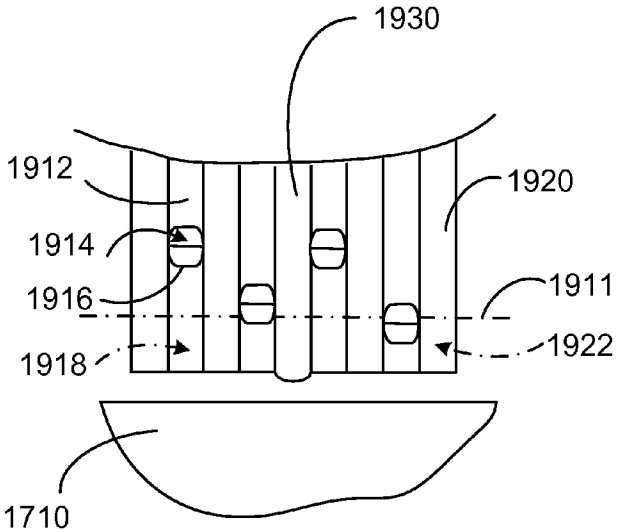
FIGS. 9A and 9B are top and side views of an apparatus for forming a fastening product.
Figure 9A:
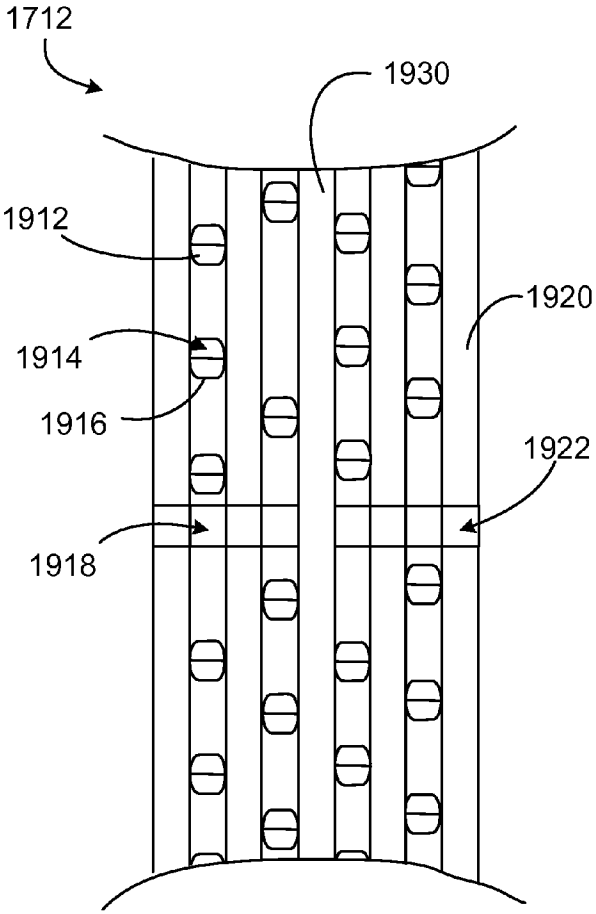

Referring to FIGS. 9A-9B, cavity roller 1712 includes multiple rings configured to form the fastener products disclosed herein. In this example, cavity roller 1712 includes multiple hook rings 1912 separated by spacer rings 1920. Each hook ring 1912 has cavities 1914 defined about its perimeter 1916 that are shaped to form the fastener elements of the fastener product, and other cavities 1918 that are configured to form portions of the lateral walls of the fastener product. To form lateral walls, the cavities 1918 of each hook ring 1912 and each spacer ring 1920 have a similar size (e.g., same width, length, and depth) and are aligned along the length of the roller. Dotted line 1911 shows the inner extent of the cavities 1918 and 1922.

To form gaps extending through the lateral walls, gap rings 1930 can be inserted among the hook rings 1912 and spacer rings 1920. The gap rings 1930 are intentionally configured to include no cavities aligned with cavities 1918. When molten resin is forced into a nip between pressure roller 1710 and cavity roller 1712, the molten resin forms the lateral walls in cavities 1918, but not in areas of the gap rings 1930, such that gaps are formed in the lateral walls. Different gap configurations can be achieved by configuring parameters of gap rings (e.g., number and thickness of gap rings).

In some examples, hook rings 1912, spacer rings 1920 and gap rings 1930 have the same diameter, and the formed gaps extend from upper surface of the base substrate of the formed fastener products (e.g., the gap 126*p* of FIG. 1P). In some examples, the gap rings 1930 have a larger diameter than the hook rings 1912 and/or spacer rings 1920, and the formed gaps may extend into the base substrate (e.g., the gap 126*s* of FIG. 1S). In some examples, a middle gap ring has the same diameter as the hook rings 1912 and/or spacer rings 1920, and two side gap rings have a smaller diameter than the middle gap ring. The middle gap ring is sandwiched by the two side gap rings, such that the formed gaps have a stepped lateral width, e.g., the gap 126*t* of FIG. 1T.

Figure 10A:
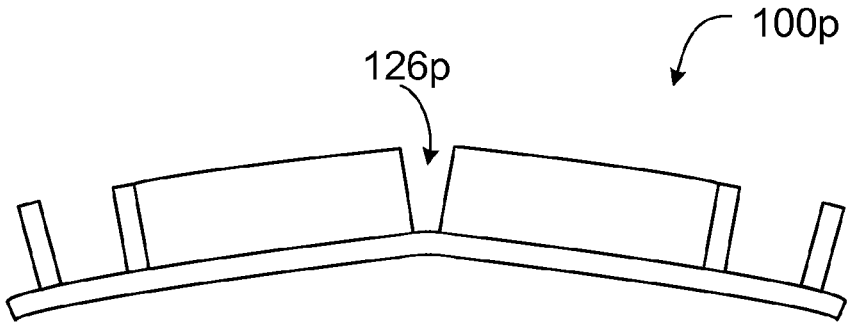
FIGS. 10A and 10B are front views of fastening products with different configurations for bending flexibility.
Figure 10B:
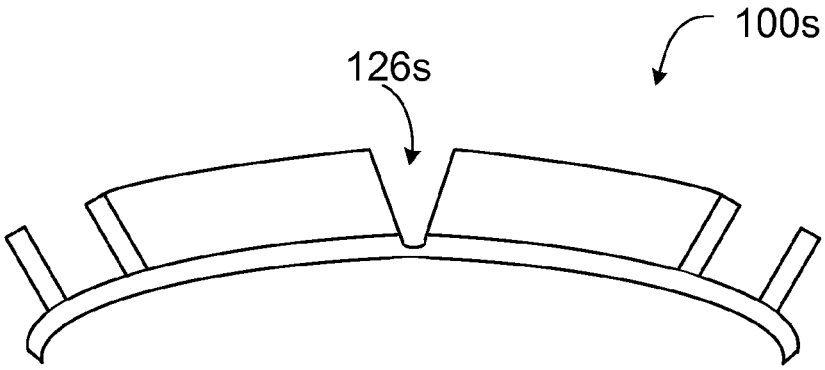

Referring to FIGS. 10A and 10B, fastener products with different configurations exhibit different bending flexibility. FIG. 10A shows the product 100*p* of FIG. 1P flexed or resiliently bent about an axis running along the length of the product. Due to gap 126*p*, the base of the product may be more readily flexed, opening gap 126*p*. FIG. 10B shows the product 100*s* of FIG. 1S similarly flexed. The longitudinal groove in the upper surface of the base at gap 126*s* further decreases the resistance to bending, enabling even greater flexibility.

Figure 11:
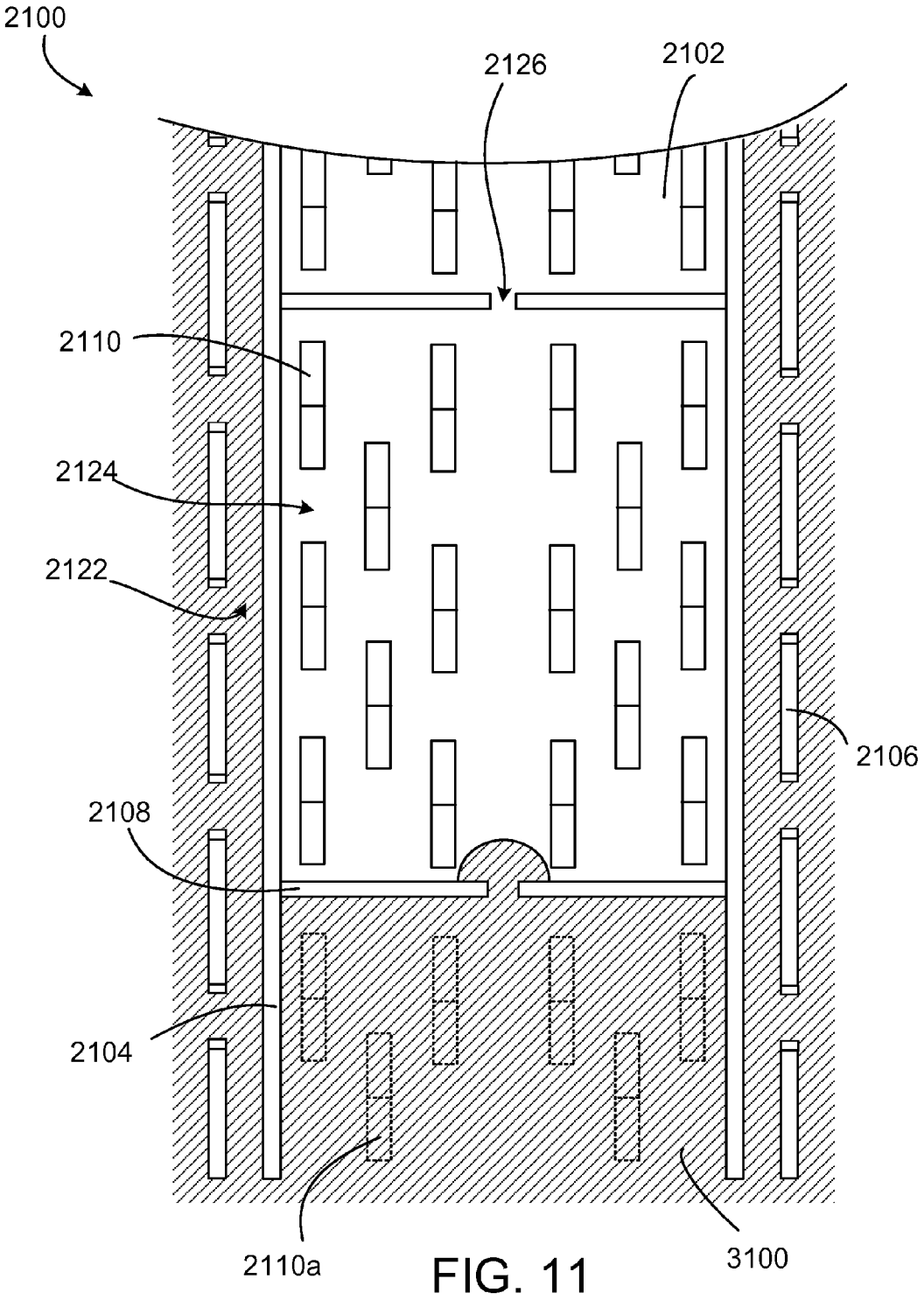
FIG. 11 is a top view of forming a molded foam article with a fastening product embedded in the article.

Referring to FIG. 11, fastener product 2100 that includes gaps extending through lateral walls, is embedded in foam 3100 to form a molded foam article. As discussed above, the fastener product can be placed on a flat surface of a mold pedestal that is disposed in the interior space of a mold cavity. The flowing foam 3100 is allowed to pass through segmented walls 2106 of the fastening product and enter appropriately dimensioned foam relief spaces 2122. The walls bordering the fastening cells (e.g., longitudinal walls 2104 and lateral walls 2108) effectively seal the interior space housing the fastening elements 2110 against the flat pedestal surface. Accordingly, the flowing foam 3100 is inhibited from fouling an excessive number of the fastener elements 2110 in flow cells 2124.

In some examples, a continuous spool of the fastener product can be severed so as to leave a partial, open cell at each end, the partial cells containing a number of fastening elements 2110*a* exposed to foam, as shown. In this example, the exposed fastening elements are embedded in the foam and act as anchor points to retain the ends of the cut product to the molded foam article. Further, the flowing foam 3100 may pass through the gaps 2126 defined through the lateral walls 2108 nearest the ends of the product and into the adjacent fastening cells 2124. With an appropriate lateral width and/or gap configuration, as discussed above, gaps 2126 may be configured to allow only a small amount of foam into the adjacent cell, such that the flowing foam is inhibited from contacting the fastener elements 2110, or limited to contacting only a few of the fastener elements, in the adjacent cell and is prevented from entering further fastener cells. Additionally, with the solidified foam, the gaps 2126 can act as additional anchor points to better hold the fastener product 2100 to the molded foam article.

Figure 12B:
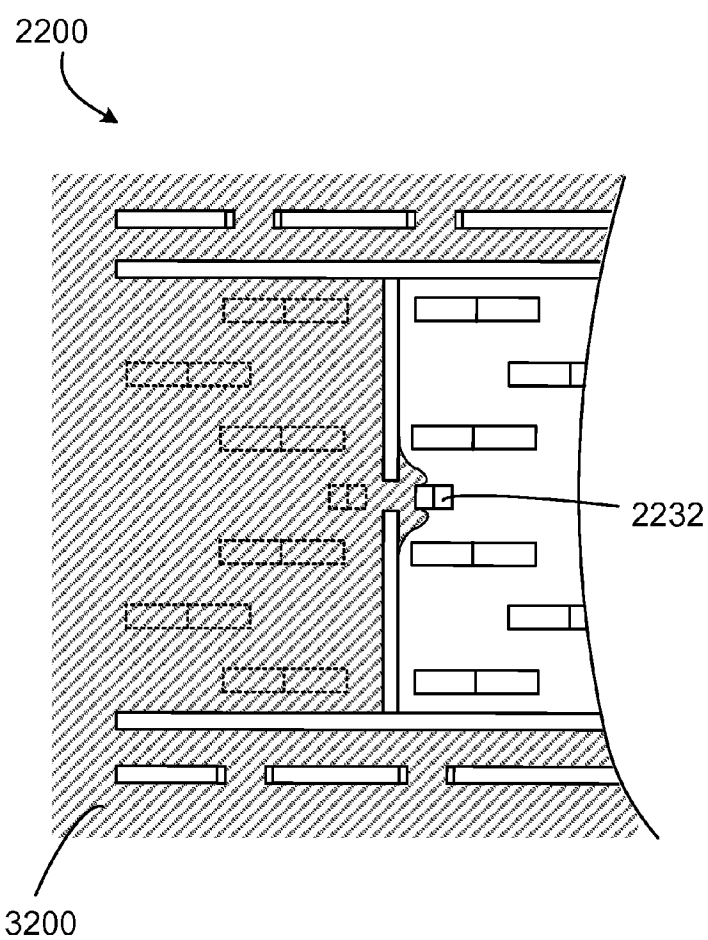
FIGS. 12A and 12B schematically and sequentially illustrate a process for forming a molded foam article with a fastening product embedded in the article.
Figure 12A:
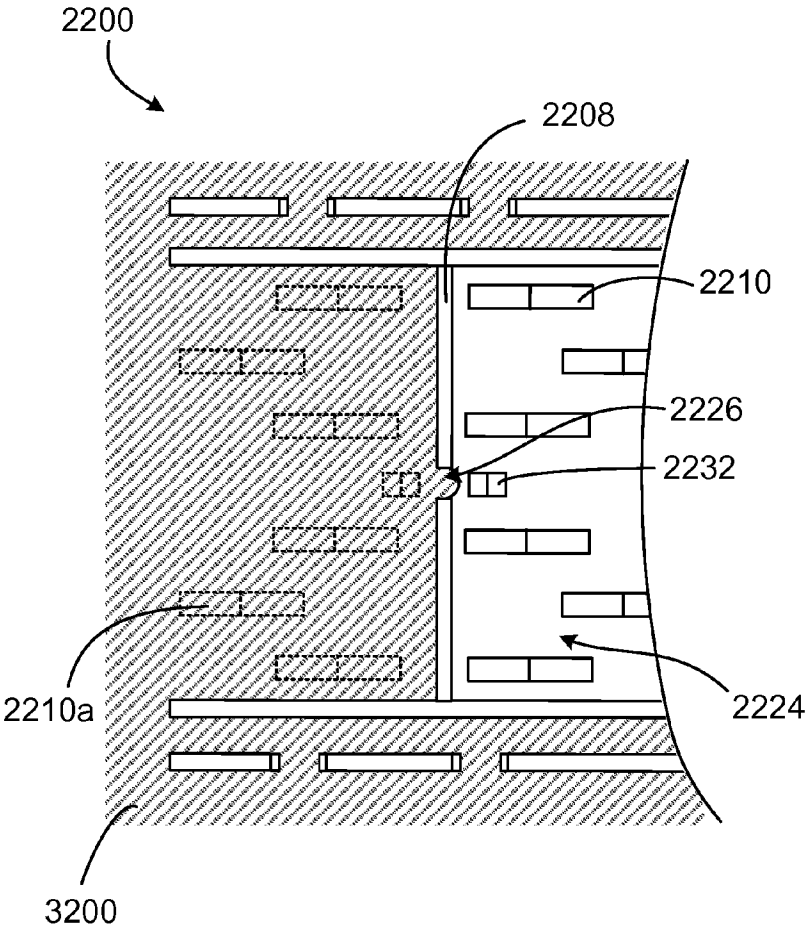

Referring to FIGS. 12A and 12B, fastener product 2200 is similar to fastener product 2100, except that fastener product 2200 includes foam disrupters 2232 adjacent gaps 2226 extending through lateral walls 2208. Flowing foam 3200 may immerse exposed fastener elements 2210*a*, and pass through gap 2226 and into adjacent fastener cell 2224. However, as discussed above, foam disrupters 2232 can effectively disturb the structure of the flowing foam. As shown in FIG. 12B, the flowing foam 3200 into the fastener cell 2224 is disturbed around the foam disrupter and inhibited from contacting the fastener elements 2210 in the fastener cell. With the solidified foam, the foam disrupters 2232 and the gaps 2226 can act as additional anchor points to better hold the fastener product 2200 to the molded foam article.

Figure 13A:
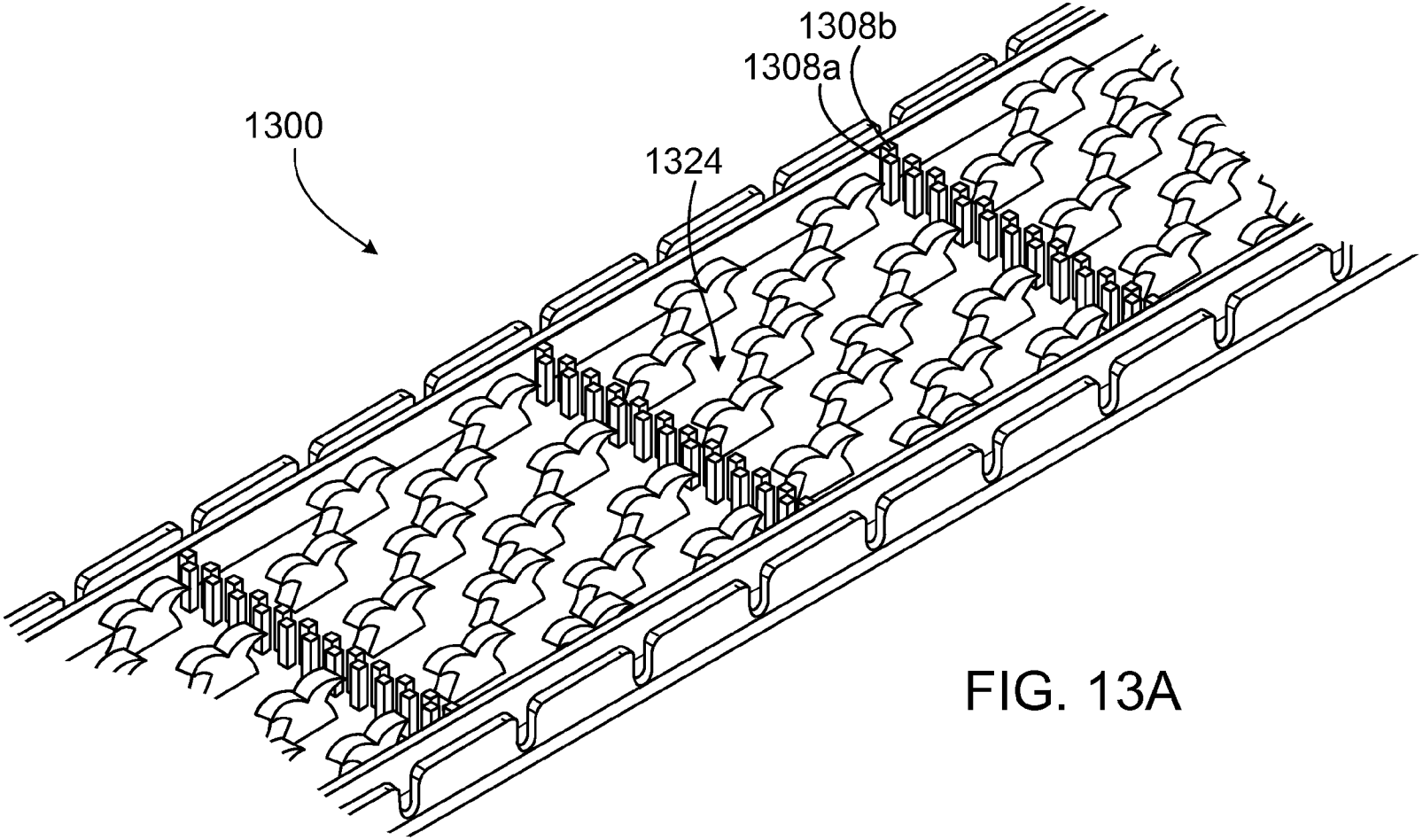
FIGS. 13A and 13B are a perspective and top view, respectively, of a fastener product with a pair of offset segmented lateral walls.
Figure 13B:
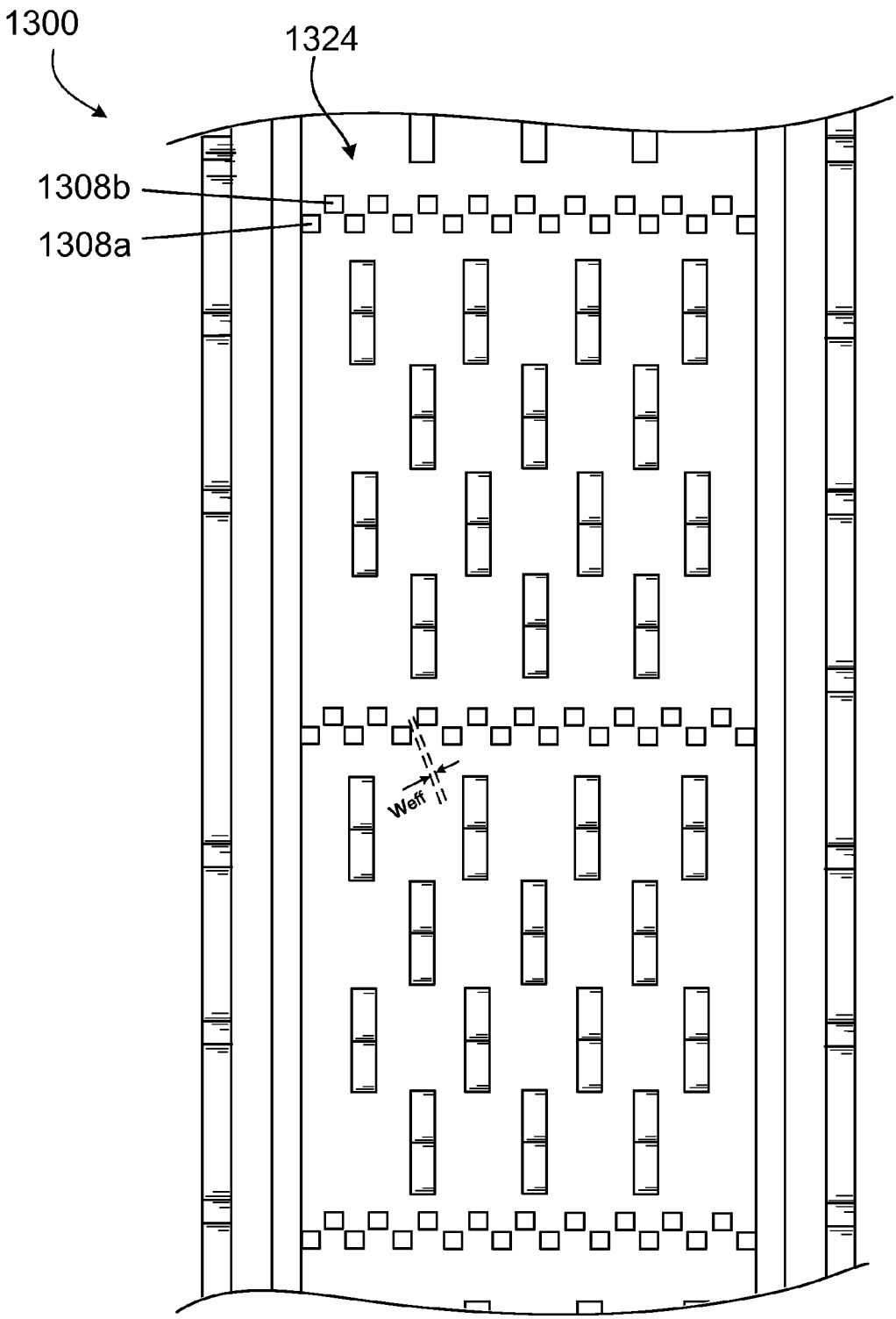
Figure 13C:
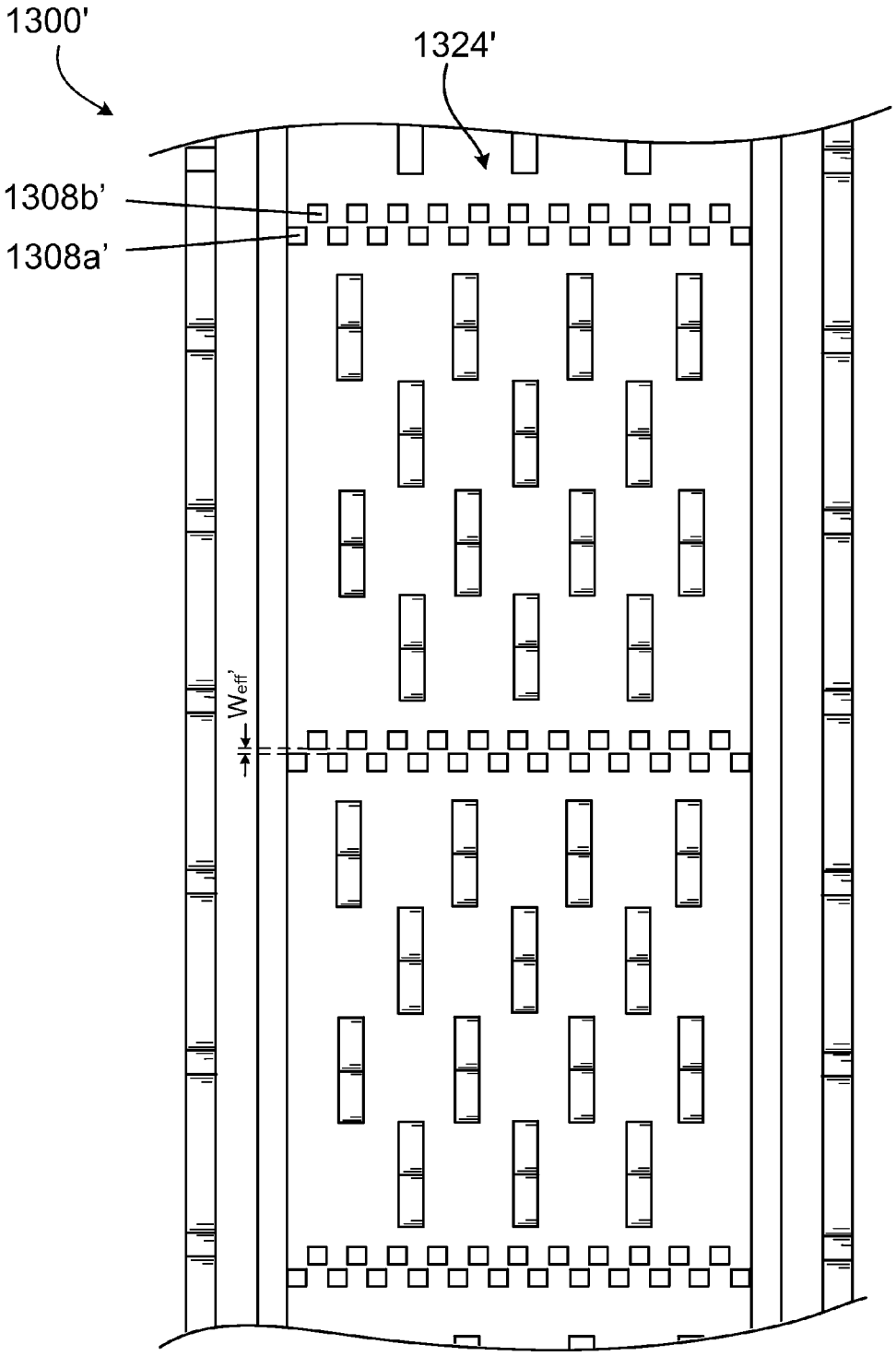
FIG. 13C is a top view of a modified fastener product.

Referring next to FIGS. 13A and 13B, in some cases any of the above examples may be modified to fastener product 1300 that provides a pair of adjacent segmented lateral walls 1308*a* and 1308 *b* between adjacent fastening cells 1324. In some cases, fastener product may include two or more segmented lateral walls between adjacent fastening cells. The lateral walls are laterally offset from one another, such that the segments of one wall are laterally aligned with the gaps of the other wall. This construction provides gaps connecting the adjacent cells, the gaps having an effective gap width $w_{eff}$ measured as the closest distance between opposed vertical edges of the segments of the lateral walls. In this manner, a series of gaps may be provided across the fastening width of the product, further enhancing lateral flexibility while preventing excessive foam intrusion between cells. In some examples, each segment of the lateral barrier walls has a longitudinal thickness of about 0.006 inch, a lateral width of between about 0.004 and 0.006 inch, and a height equal to the height of the longitudinal walls, or about 0.05 inch. In some cases, as shown in FIG. 13B, the effective gaps between the adjacent segments of the lateral barrier walls may have a width of about 0.001 inch. FIG. 13C shows a modified fastener product 1300', where the adjacent segments of the lateral barrier walls have a longitudinal gap width of about 0.002 inch and a lateral gap width of about zero. In other words, the edges of the segments of one lateral barrier wall are laterally aligned with those of the other lateral barrier wall. Preferably the effective gap width is less than or equal to about 0.003 inch (more preferably, less than about 0.0015 inch). The effective gap width may be selected so as to allow the flowing foam to at least partially imbed the segments within the stabilized foam, while slowing down the foam flow so as to prevent excessive intrusion into the next fastening cell. Furthermore, the large number of gaps along the transverse walls allows for increased flexibility at several points along the width of the product, for accommodating various curves. It will be understood that the lateral barrier wall segments may be configured to be laterally aligned with the fastener elements, such that some of the segments are formed within the width of molding rings that form respective rows of fastener elements, while other lateral barrier wall segments are formed within other rings. Lateral barrier wall segments may be formed by aligned grooves in adjacent rings, or even by a set of rings that is permanently laminated for durability.

It will be seen by those skilled in the art that many embodiments taking a variety of specific forms and reflecting changes, substitutions, and alternations can be made without departing from the spirit and scope of the invention. Therefore, the described embodiments illustrate but do not restrict the scope of the claims.

What is claimed is:

1. A male touch fastener strip comprising:

an elongated base having a thickness and defining a longitudinal direction and a lateral direction perpendicular to the longitudinal direction across the base between longitudinal edges of the base;

a field of male fastener elements each having a stem extending from a broad face of the base and a head at an upper end of the stem and overhanging the base for engaging fibers, the fastener element stems and broad face of the base together forming a unitary mass of resin;

a pair of longitudinal barrier walls rising from the broad face of the base on either side of the field of male fastener elements; and a plurality of lateral barrier walls, each of the lateral barrier walls extending between facing surfaces of the longitudinal barrier walls to define a longitudinal column of bounded fastening cells that each contain one or more of the male fastener elements, with each lateral barrier wall bounding two adjacent fastening cells;

wherein each lateral barrier wall defines at least one gap extending therethrough to define a flow path between the two adjacent fastening cells bounded by the lateral barrier wall.

2. The male touch fastener strip of claim 1, wherein the longitudinal barrier walls are lengthwise continuous.

3. The male touch fastener strip of claim 1, wherein the gaps defined by the lateral barrier walls extend from the broad face of the base.

4. The male touch fastener strip of claim 1, wherein each lateral barrier wall defines multiple gaps extending therethrough.

5. The male touch fastener strip of claim 1, wherein the gaps defined by the lateral barrier walls each define a lateral gap width of between about 0.002 and 0.015 inch.

6. The male touch fastener strip of claim 1, wherein the gaps defined by the lateral barrier walls each have a width that varies with distance from the broad face of the base.

7. The male touch fastener strip of claim 6, wherein the gaps defined by the lateral barrier walls are wider at their distal extent than at a height closer to the broad face of the base.

8. The male touch fastener strip of claim 1, further comprising foam disrupters rising from the broad surface of the base within the fastening cells adjacent the gaps.

9. The male touch fastener strip of claim 8, wherein the foam disrupters are of a height less than a height of the lateral barrier walls.

10. The male touch fastener strip of claim 8, wherein the foam disrupters extend, in a side profile, to distal points that define a point radius of less than about 0.0015 inch.

11. The male touch fastener strip of claim 1, wherein the broad face of the base defines a longitudinal groove connecting and forming a lower extent of the gaps defined by the lateral barrier walls.

12. The male touch fastener strip of claim 1, wherein the longitudinal barrier walls each comprise a longitudinal column of spaced-apart wall segments defining longitudinal gaps therebetween.

13. The male touch fastener strip of claim 1, wherein the lateral barrier walls each have a height at least as great as that of the male fastener elements.

14. The male touch fastener strip of claim 1, wherein the lateral barrier walls are spaced apart from one another by between 0.3 and 0.5 inch in the longitudinal direction.

15. A male touch fastener strip comprising:

an elongated base having a thickness and defining a longitudinal direction and a lateral direction perpendicular to the longitudinal direction across the base between longitudinal edges of the base;

a field of male fastener elements each having a stem extending from a broad face of the base and a head at an upper end of the stem and overhanging the base for engaging fibers, the fastener element stems and broad face of the base together forming a unitary mass of resin;

a pair of longitudinal barrier walls rising from the broad face of the base on either side of the field of male fastener elements; and a plurality of lateral barrier walls, each of the lateral barrier walls extending between facing surfaces of the longitudinal barrier walls to define a longitudinal column of bounded fastening cells that each contain one or more of the male fastener elements;

wherein each lateral barrier wall defines at least one gap extending therethrough and connecting adjacent fastening cells; and wherein the longitudinal barrier walls are lengthwise continuous.

16. A male touch fastener strip comprising:

an elongated base having a thickness and defining a longitudinal direction and a lateral direction perpendicular to the longitudinal direction across the base between longitudinal edges of the base;

a field of male fastener elements each having a stem extending from a broad face of the base and a head at an upper end of the stem and overhanging the base for engaging fibers, the fastener element stems and broad face of the base together forming a unitary mass of resin;

a pair of longitudinal barrier walls rising from the broad face of the base on either side of the field of male fastener elements; and a plurality of lateral barrier walls, each of the lateral barrier walls extending between facing surfaces of the longitudinal barrier walls to define a longitudinal column of bounded fastening cells that each contain one or more of the male fastener elements;

wherein each lateral barrier wall defines at least one gap extending therethrough and connecting adjacent fastening cells, and wherein the broad face of the base defines a longitudinal groove connecting and forming a lower extent of the gaps defined by the lateral barrier walls.

* * * * *